US006708547B2

(12) United States Patent
Narita et al.

(10) Patent No.: US 6,708,547 B2
(45) Date of Patent: Mar. 23, 2004

(54) ROLLING MILL AND ROLLING METHOD

(75) Inventors: Kenjiro Narita, Hitachinaka (JP); Mitsuo Nihei, Hitachi (JP); Takehiko Saito, Hitachi (JP); Toshiyasu Shinmura, Hitachi (JP); Shinichi Kaga, Hitachi (JP); Takashi Kamoshita, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 55 days.

(21) Appl. No.: 10/105,445

(22) Filed: Mar. 26, 2002

(65) Prior Publication Data

US 2002/0100307 A1 Aug. 1, 2002

Related U.S. Application Data

(62) Division of application No. 09/659,080, filed on Sep. 11, 2000.

(30) Foreign Application Priority Data

Dec. 21, 1998 (JP) ..... 10-362132

(51) Int. Cl.[7] ..... B21B 27/06

(52) U.S. Cl. ..... 72/236; 72/7.6; 72/11.1; 72/11.6; 72/365.2; 451/5; 451/49

(58) Field of Search ..... 72/10.1, 236–247, 72/365.2, 7.4, 7.6, 8.3, 11.1, 8.9, 11.6; 451/5, 49

(56) References Cited

U.S. PATENT DOCUMENTS

| | | | | |
|---|---|---|---|---|
| 4,619,080 A | * 10/1986 | Okamoto et al. | ..... | 451/424 |
| 4,827,751 A | * 5/1989 | Holthoff | ..... | 72/236 |
| 5,174,144 A | * 12/1992 | Kajiwara et al. | ..... | 72/236 |
| 5,970,771 A | * 10/1999 | Ginzburg | ..... | 72/201 |
| 6,014,881 A | * 1/2000 | Imanari | ..... | 72/201 |
| 6,029,491 A | * 2/2000 | Ginzburg | ..... | 72/10.6 |
| 6,076,388 A | * 6/2000 | Kajiwara et al. | ..... | 72/236 |
| 6,585,558 B1 | * 7/2003 | Mori et al. | ..... | 451/5 |

FOREIGN PATENT DOCUMENTS

| | | | | |
|---|---|---|---|---|
| JP | 51-7635 | 3/1976 | | |
| JP | 58-176004 | * 10/1983 | ..... | 72/236 |
| JP | 61-296310 | 12/1986 | | |
| JP | 2708351 | 10/1997 | | |

* cited by examiner

*Primary Examiner*—Ed Tolan
(74) *Attorney, Agent, or Firm*—Crowell & Moring LLP

(57) ABSTRACT

There are disclosed a rolling mill capable of keeping a uniform plate of thickness distribution and manufacturing a good-quality plate, and a rolling method. The rolling mill comprises working rolls movable in roll axis directions, profile-measuring means for measuring the profile of each of the working rolls, profile-estimating means for estimating the profile thereof, and a grinder for grinding each of the working rolls. The rolling mill also comprises instructing means for sending a command of grinding to the grinder at a time when the measured profile value or the estimated profile value regarding each of the working rolls reaches a given value.

8 Claims, 21 Drawing Sheets

ROLLING MILL AND ROLLING METHOD

This application is a Division of Ser. No. 09/659,080 filed on Sep. 11, 2000.

BACKGROUND OF THE INVENTION

1. Field of the Invention

The present invention relates to a plate rolling mill. More particularly, the invention relates to a rolling mill including a grinder installed in a rolling stand to grind the surface of each of working rolls, and a rolling method, the rolling mill being suited for rolling a plate requiring good quality, especially a metal plate, and the working rolls being movable in axial directions.

2. Description of the Related Art

In the field of plate rolling, there has been a demand for a plate quality improvement. The profile of a working roll surface has been improved in an effort to increase the accuracy of plate dimensions, and various types of rolling mills have been developed. For example, Conventional Technology 1 (JP-B-51-7635) discloses a 4-high rolling mill having working rolls and reinforcing rolls provided in its rolling stand. The working rolls are movable in axial directions, and working rolls bender is installed. According to the Conventional Technology 1, the controllability of plate thickness distribution can be improved by changing an axial position of each of the working rolls, and by using the working roll bender in combination. In addition, according to the Conventional Technology 1, by changing the axial position of the working roll, the surface region of the working roll brought into contact with a plate is changed in the axial direction, the wear of the working roll surface being uniformed, and local uneven wear is minimized. Thus, there is obtained an advantage in manufacturing cost because of a prolonged time of using the working roll. Moreover, according to the Conventional Technology 1, a thermal crown and a wear crown occurring on the working roll surface are cancelled each other, and a coffin type limitation hitherto occurring regarding the plate width order of a rolling schedule is relaxed. Thus, it is possible to make a rolling schedule more freely. For the foregoing reasons, the Conventional Technology 1 has been widely accepted in a plate manufacturing field, and still used.

Another Conventional Technology 2 (JP-B-2708351) discloses a rolling mill including an on-line roll grinder. According to the Conventional Technology 2, a grindstone brought into contact with a working roll is formed to have a highly elastic thin disk-like structure, so that the effect of whirling caused by the vibration of the working roll or the eccentricity of a shaft center line is absorbed for good grinding, whereby even in an actual rolling mill, stable grinding is performed. In addition, according to the Conventional Technology 2, there is provided such a function as to detect a profile of the working roll while pressure-contacting the grindstone onto the surface of the working roll with a constant force so that the movement of the grindstone may be detected to thereby obtain irregularity on the working roll surface. Thus, it is possible to grind in an on-line manner each of the working rolls by detecting the profile of the working roll. In the Conventional Technology 2, a period of time for using the working roll can be further prolonged by performing grinding during the rolling. As in the case of the Conventional Technology 1, it becomes possible to obtain a considerably free rolling schedule, and the rolling mill has been used in the plate manufacturing field.

Still another Conventional Technology 3 (JP-A-61-296910) discloses a method of making a wide wear profile by using both of roll-shifting and grinding a roll surface region of each of the working rolls which region is located outside of a plate to be rolled (, which grinding is referred to as "plate-outside-grinding" hereinafter). According to the Conventional Technology 3, as in the case of the Conventional Technology 1, since the changing of the axial position of the working roll makes the uniform wear on the working roll surface and minimize local uneven wear, there is such an advantage to make the manufacturing cost low because of a prolonged period of time regarding the use of the working rolls. Moreover, a working roll region located outside a plate width is ground by an amount equal to the amount of working roll center wear so that the abrupt change of the wear profile may occur outside of the plate width. Thus, any contact is prevented from occurring between the plate to be rolled and the working roll region having a considerably changed wear profile. In this way, since the transfer of the abruptly changed wear profile portion of the working roll to the plate is prevented, the influence of the wear profile of the working roll surface on the plate to be rolled is deemed to become small.

SUMMARY OF THE INVENTION

However, in any of the foregoing Conventional Technologies 1 to 3, no specific means has been disclosed from the viewpoint of keeping a good profile of the working roll surface over the whole of rolling cycles in order to prevent the defects of a plate surface from occurring which defects are considered to be the problem of plate quality. As the result of the researches of the inventors of the invention, the inventors discovered that when rolling was performed by any one of the Conventional Technologies 1 to 3, deterioration of plate quality occurred with the progress of rolling, making it difficult to perform many times of plate-rolling. This problem will now be explained while referring to the drawings.

FIGS. 2A and 2B illustrate working roll surface profiles and thermal expansion and wear profiles which constitute the working roll surface profile, in a case where plates equal in width are subjected to hot rolling by using a rolling mill having no working roll shifting. The working roll surface profiles shown in FIGS. 2A and 2B indicate change per roll radius. In the case of usual rolling of a plate, a temperature of plate end portions are lower than that of a plate center, and plate surface scales and hardness are different between the plate center and the plate end portions. The wear amount of a working roll region brought into contact with each of the plate end portions is larger than that of another working roll region brought into contact with the plate center (larger by 1.05 to 1.25 times than center wear). In other words, working roll wear takes a peak shape at the working roll end region. The thermal expansion profile of the working roll surface becomes a constant, gently-sloping profile saturated after the rolling of 40 or more pieces of rolled plates. Accordingly, as shown, the working roll surface profile constituted by the wear and thermal expansion profiles receives the great influence of the shape of the end portion peak wear, and is suddenly changed near the plate end portions. When such a suddenly changed working roll region is brought into contact with and transferred to the plate, flaws or defects occur on the plate surface. Thus, the contact of this region with the plate must be avoided. For this reason, there has been used such a so-called "coffin schedule" of rolling as the rolling is performed by a process having the steps of: sequentially changing plate widths so that the width of each of the plates to be rolled is increased sequentially till such a period of time of small wear as to correspond to about 10 to 20 pieces of rolled plates to thereby make the thermal expansion profile dispersed; and then changing the plate width so that the width of each of the plates to be rolled becomes narrow sequentially to prevent the working roll end regions having the peaks of the wear profile from contacting with the plates.

FIGS. 3A and 3B illustrate working roll surface profiles and thermal expansion and wear profiles which constitute each of the working roll surface profiles, in a case where the working roll shifting of the Conventional Technology 1 is performed and plates equal in width are subjected to hot rolling. Each of the working roll surface profiles shown in the drawings indicates a change per roll radius. In the case of the profiles, the working roll is moved 10 mm axially every two pieces of rolled plates, and a maximum moving position is ±100 mm. It can be understood from the drawings that the shape of the peak wear of the working roll end regions occurring in the case of no working roll shifting disappears. The working roll surface profile corresponding to 44 pieces of rolled plates takes a gentle-sloping shape and, since the wear profile and the thermal expansion profile are cancelled each other, the surface profile also becomes smaller in value. As this working roll surface profile is for one working roll and upper and lower working rolls are located in point symmetry to the place center, the profile of roll gaps symmetrical left and right is transferred to the plate. By making effective use of this, the limitation occurring regarding the plate width order of the coffin schedule type is relaxed, making it possible to make a considerably free rolling schedule. However, a period of time regarding this advantage is short and, if rolling further proceeds, the wear profile like the that of 160 pieces of rolled plates shown in FIG. 3B becomes predominant, resulting in a working roll surface profile having the great change near the plate end portions. This is attributed to the fact that, although the growth of the thermal expansion profile is saturated by about 40 pieces of rolled plates, wear is increased in proportion to the number of pieces of rolled plates and the wear profile is also enlarged in unlimited manner. Therefore, strictly speaking, the range of the number of rolled plates in which the wear and thermal expansion profiles can be cancelled each other is extremely narrow. In other words, even in a case of using the working roll shifting, wear becomes large after a certain number of rolled plates with the result that the plate profile is deteriorated, and thus the working rolls must be changed before the deterioration. It can therefore be said that the use of the Conventional Technology 1 brings about the cancellation effect of the wear and thermal expansion profiles, but this effect terminates in a short period of time. Further, since the wear is increased in proportion to the number of rolled plates, it can be said that the number of rolled plates obtained by the same working roll is not increased so much.

FIGS. 4A to 4C illustrate working roll surface profiles when rolling is performed by using the on-line roll grinder of the Conventional Technology 2. The working roll surface profile shown in the drawing indicates a change per roll radius. If no working roll shifting is performed as in the case described above with reference to FIGS. 2A and 2B, the wear profile of a working roll takes the shape of peak wear in each end portion. The peak wear must be removed to relax the limitation of the coffin schedule, and the case of grinding the whole working roll region located outside a plate width down to a peak depth is assumed herein. In this case, because of the grinding of the whole working roll region located outside the plate width to the peak depth, a surface profile becomes gentle-sloping having no peak wear in any case of the 42 and 160 pieces of rolled plates. However, as apparent from the deformation amount of a working roll center region, wear and thermal expansion profiles of the working roll surface corresponding to the inside of the plate width act not to be cancelled each other but to be added to each other to make the working roll surface profile large in value, and there is no cancellation effect between the wear and thermal expansion profiles, causing the surface profile to be larger in values than the thermal expansion profile. If rolling is further continued, the wear profile having a peak in the working roll region corresponding to the inside of the plate width becomes large, leading to further enlargement of the working roll surface profile, and this enlargement develops to an unlimited extent. Since the amount of grinding corresponds to the amount of the peak wear, the depth of the grinding is necessary to be larger by 1.05 to 1.25 times than that in the case of no peak wear influence. Thus, by using the Conventional Technology 2, the surface profile becomes gentle-sloping, and it lasts for a long period of time. However, it is pointed out that there is no cancellation effect between the wear and thermal expansion profiles, and the increasing of the value of the working roll surface profile proceeds. In addition, the amount of roll grinding must be set deep, and cost performance regarding the use of rolls is not so advantageous.

FIGS. 5A to 5C illustrate working roll surface profiles in a case of rolling performed while making a wide wear profile by using in combination the working roll shifting and the "plate-outside-grinding" of the working roll in the Conventional Technology 3. The working roll surface profile shown in the drawing indicates a change per roll radius. As described above with reference to FIG. 3, according to the Conventional Technology 3, the working roll shifting removes the shape of peak wear in the end portion, and the grinding of the working roll end region located outside the plate width down to the amount of the working roll wear depth corresponding to the plate center for each rolling makes the working roll surface profile almost equivalent to the thermal expansion profile of the working roll. Accordingly, the surface profile becomes a gentle-sloping profile in any of the 42 and 160 pieces of rolled plates. However, as apparent from the amount of a roll center surface deformation shown in FIG. 5C, there is no cancellation effect between the wear and thermal expansion profiles, and the surface profile is large which corresponds directly to the value of the thermal expansion profile. It is apparent that by using the Conventional Technology 3, the surface profile becomes gentle-sloping and it lasts long, but there is not any cancellation effect at all between the wear and thermal expansion profiles, and the working roll surface profile becomes large. Thus, as a technical problem, there occurs the improper profile on the working roll surface, which becomes a problem when rolling is performed by using the working rolls. The deterioration of the working roll surface profile causes uneven plate thickness distribution, the deterioration of plate quality and other disadvantages, resulting in the difficulty of stable rolling of good-quality plates.

An object of the invention is to provide a rolling mill of a type having in a rolling stand a grinder for grinding the surface of a working roll movable in an axial direction, which rolling mill is capable of providing a uniform plate thickness distribution and manufacturing a good-quality plate.

Another object of the invention is to provide a rolling method capable of providing a uniform plate thickness distribution and manufacturing a good-quality plate.

According to the first aspect of the invention, there is provided a rolling mill comprising at least one pair of upper and lower working rolls each movable in a direction of axis of each of said rolls, at least one of profile-measuring means for measuring a profile of said working rolls and profile-estimating means for estimating said profile of said working rolls, grinding means for grinding a surface of said working rolls, and grinding-instructing means for instructing the grinding means to perform grinding of the working rolls when at least one of a value of measured profile of said working rolls and another value of estimated profile of said working rolls reaches a given value.

According to the second aspect of the invention, there is provided a rolling mill for producing a plate, comprising a rolling stand, at least one pair of upper and lower working rolls provided in said rolling stand and movable in a direction toward a driving side of said rolling mill or in another direction reverse to the former direction each of which working rolls is moved in a direction reverse to each other, and working rolls-grinding means for grinding a working roll surface region located outside of a width of said plate which portion is to be in pressure-contact with the plate during succeeding rolling operations performed thereafter by axial movement of said working rolls, or for grinding another region further including more outside working roll region than the former working roll region, or for grinding a whole working roll surface region located outside of said width of said plate, so that a wear profile of each of said working rolls has a suppressed growing rate of depth of wear occurring in the working rolls during rolling or so that said wear profile has a constant depth of said wear.

According to the third aspect of the invention, there is provided a rolling mill for producing a plate, comprising a rolling stand, at least one pair of upper and lower working rolls provided in said rolling stand which working rolls are movable in the direction of axis of said working rolls, grinding means provided in the rolling stand which grinding means grinds a surface of said working rolls, means for storing and calculating a cumulative number of pieces of rolled plate produced or amount of rolling performed in a period of time continuing from initial use of said working rolls, and grinding-instructing means for instructing the grinding means to perform grinding of the working rolls when said number of piece of said rolled plate or the amount of said rolling reaches a given value.

According to the fourth aspect of the invention, there is provided a method of rolling by use of a rolling mill comprising at least one pair of upper and lower working rolls each movable in a direction of axis of each of said rolls, at least one of profile-measuring means for measuring a profile of said working rolls and profile-estimating means for estimating said profile of said working rolls, and grinding means for grinding a surface of said working rolls, said method comprising the steps of comparing a given value with at least one of a measurement value obtained by said profile-measuring means and an estimated value obtained by said profile-estimating means, and instructing said grinding means to perform grinding of the working rolls when said at least one exceeds said given value.

According to the fifth aspect of the invention, there is provided a method of rolling a plate by use of a rolling mill comprising a rolling stand, at least one pair of upper and lower working rolls provided in said rolling stand and movable in a direction toward a driving side of said rolling mill or in another direction reverse to the former direction each of which working rolls is moved in a direction reverse to each other, and working rolls-grinding means for grinding a working roll, said method comprising the steps of measuring or estimating a depth of wear of said working rolls, performing, when said measured or estimated depth of the wear of said working roll reaches a given value, grinding a working roll surface region located outside of a width of said plate which region is to be in pressure-contact with the plate during succeeding rolling operations performed thereafter because of axial movement of said working rolls, or grinding another region including a more outside working roll region than the former working roll region, or grinding a whole working roll surface region located outside of said width of said plate, so that a wear profile of each of said working rolls has a suppressed growing rate of depth of wear occurring in the working rolls during rolling or so that said wear profile has a constant depth of said wear.

According to the sixth aspect of the invention, there is provided a rolling method for rolling a plate by a rolling mill having at least a pair of upper and lower working rolls in a rolling stand, comprising the steps of:

moving the working rolls in axial directions;

grinding a surface of each of the working rolls by a grinder;

calculating the number of pieces of rolled plate or a rolling amount by a storing and calculating means; and commencing grinding of each of the working rolls when the number of pieces of the rolled plate produced or the amount of rolling performed after replacement of the working roll reaches a given value predetermined on the basis of calculation or previously obtained data based on actual values.

BRIEF DESCRIPTION OF THE DRAWINGS

FIGS. 6A, 6B and 6C are views illustrating the occurrence of working roll surface profiles in the first embodiment of the invention.

DETAILED DESCRIPTION OF PREFERRED EMBODIMENTS

Next, the embodiments of the present invention are described below in detail with reference to the accompanying drawings.

Figure 1A:
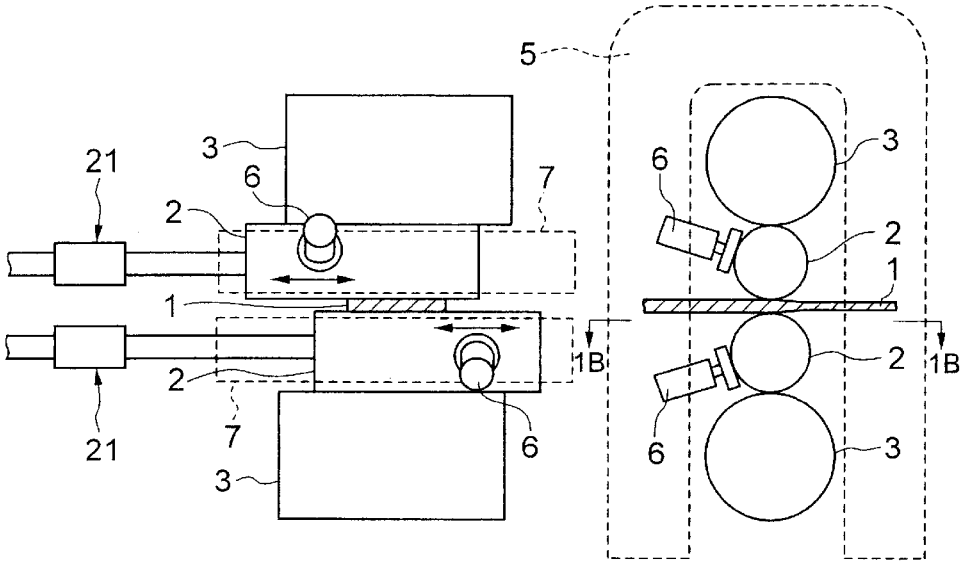
FIGS. 1A, 1B and 1C are views illustrating a mechanism of a rolling mill and a working roll profile according to the first embodiment of the present invention.
Figure 1B:
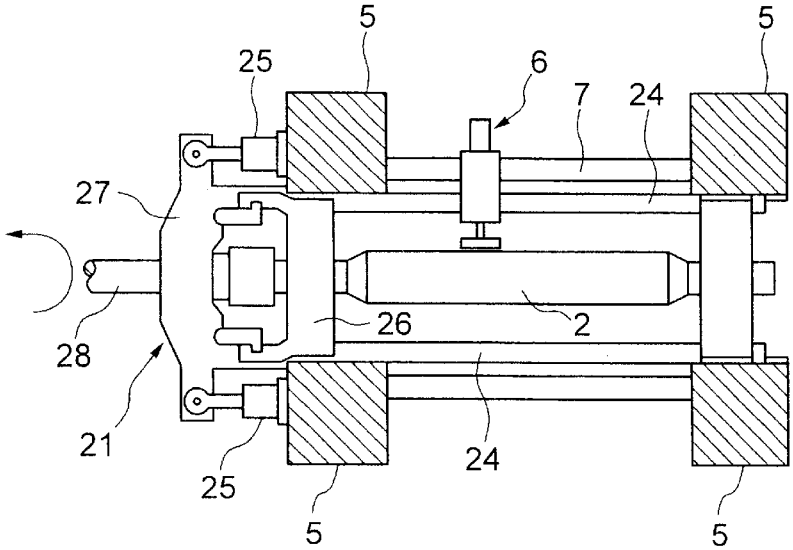
Figure 1C:
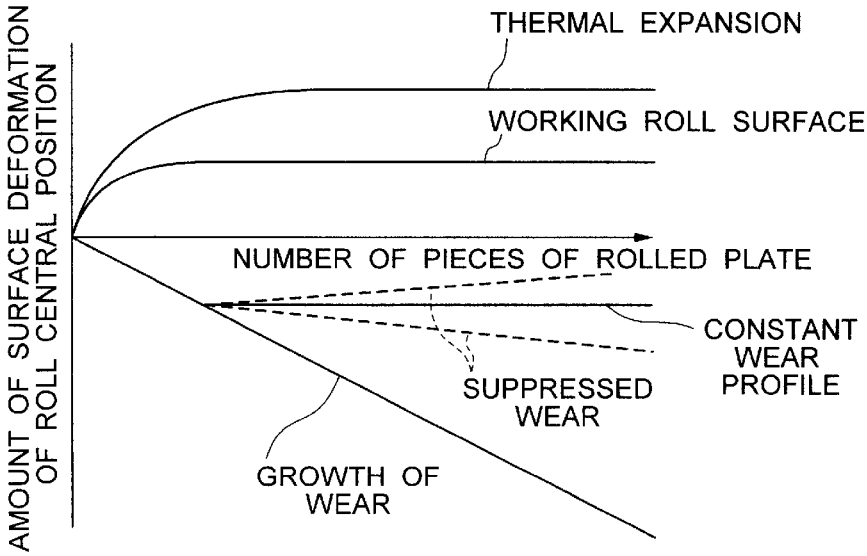
Figure 2A:
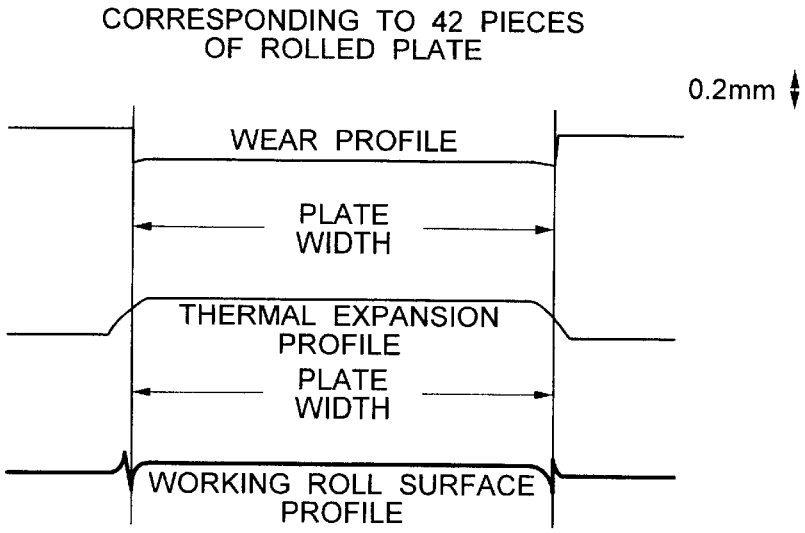
FIGS. 2A and 2B are views illustrating the occurrence of working roll surface profiles.
Figure 2B:
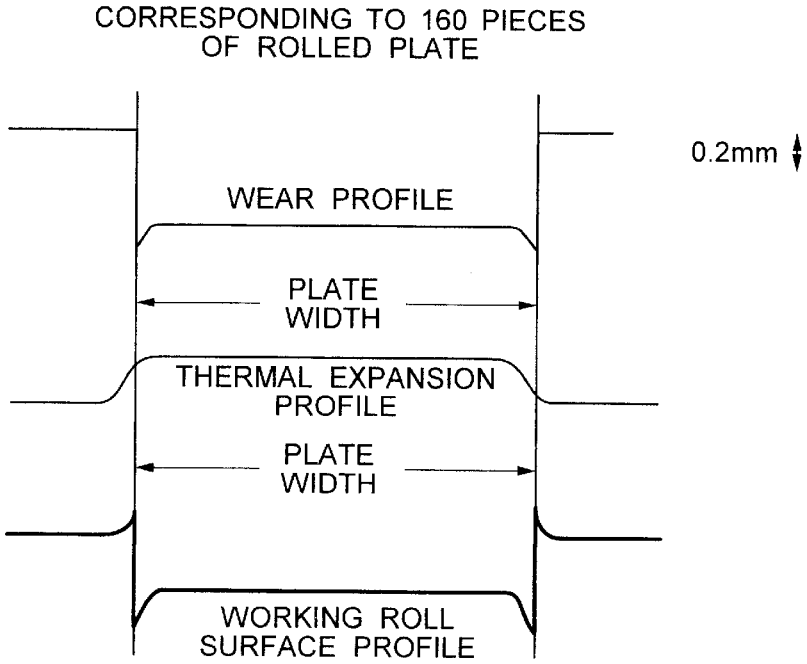

FIGS. 1A and 1B illustrate a hot rolling mill used to perform hot rolling for producing a coil of a steel plate having a width of 1200 or 1500 mm and a thickness of 1 or 2 mm, which hot rolling mill is provided with a grinder 6 for grinding the surface of each of working rolls 2 according to the first embodiment of the invention which working rolls are movable in the axial direction by roll-moving means 21, each of the working rolls being provided with a diameter of 680 mm and a barrel length of 2000 mm.

In FIGS. 1A and 1B, a pair of working rolls 2 and reinforcing rolls 3 are provided in a rolling stand 5, the upper and lower working rolls 2 being movable in respective axial directions, and a grinder 6 is installed to grind the surface of each of the working rolls 2, the grinder 6 being provided with the same structure as disclosed in JP-B-2708351, the disclosure of which is incorporated by reference herein. The grinder 6 is axially movable on a moving base 7 fixed to the rolling stand 5. By being axially moved and brought into contact with the surface of the working roll 2, the grinder 6 can grind a non-contact working roll region located outside of the rolled plate which region is to be brought into contact with a plate in the succeeding rolling operation performed thereafter, or another working roll region further including a more outside portion than the former region, or the whole working roll region located outside of the plate to be rolled.

As shown in FIG. 1B, the working roll 2 is located above a shift flame 24 through a working roll chock provided as one element of the roll-moving means 21. That is, the roll-moving means 21 are provided with: the working roll chock 26 slidable on the shift flame 24 fixed to the rolling stands 5; hydraulic cylinder means 25 fixed to the rolling stands 25 which cylinder means 25 has a movable portion; and an arm 27 connected to the movable portion of the cylinder means 25. The arm 27 of the roll-moving means 21 is located so that the arm 27 may not interfere with a driving spindle 28 which is connected to the working roll 2 to thereby transfer rotational driving force to the working roll 2, and the arm 27 is connected to the working roll chock 26.

By varying the hydraulic pressure of the hydraulic cylinder means 25, the movable portion of the hydraulic cylinder means is moved forward is retracted to shift the locations of the arm 27 and the working roll chock 26 without any interference with the driving spindle 28, whereby the working roll 2 located on the shift flame through the working roll chock 26 of the roll-moving means is moved in the direction of the axis of the working roll.

The upper and lower working rolls 2 are moved in roll axis directions opposite to each other. As described above, the working roll shifting makes it possible to obtain a gentle-sloping wear profile having no end portion peak wear which wear profile is similar to a thermal expansion profile.

The deformation amount of the surface of each working roll occurs as the total amount of thermal expansion and wear. As shown in FIG. 1B, the thermal expansion and the wear occur in such a relation as to be cancelled each other. In other words, because of the thermal expansion, the working roll 2 tends to have a swelled shape at its center portion. On the other hand, in the case of the wear of the working roll 2, a working roll region in pressure contact with a plate to be rolled tends to be reduced in radius (usually, at a specified range near the center thereof), forming a recessed shape at the working roll region in pressure contact with the rolled plate.

The thermal expansion reaches a saturation state by a certain number of rolled plates, however, the increase of the wear proceeds without any saturation.

In the embodiment of the invention, by making good use of profile variations caused by the thermal expansion of the working roll, the wear profile is cancelled or reduced as much as possible so that the actual profile of the working rolls may be optimized. Thus, the working roll profile can be formed to be a proper and desired shape, and a rolled plate having good surface quality and shape can be obtained. Since the roll profile can be maintained in a stable manner in the proper and desired shape, a rolled plate having good surface quality and shape can be produced in a stable manner. In addition, since the thermal expansion profile is used in the good manner, the amount of roll-grinding is smaller than that in the conventional case, prolonging a roll service life.

According to the first embodiment of the invention, at the time when the wear depth of the working roll reaches a given value, the grinder 6 begins to grind a non-contact working roll region located outside of the rolled plate which region is to be in contact with the plate in the succeeding rolling operation performed thereafter, or another working roll region further including a more outside portion than the former region, or the whole working roll region located outside of the rolled plate. The given value of the working roll wear depth (roll profile) in this case means a predetermined value at which the thermal profile is saturated and at which the influence of the wear profile becomes so large that the desired cancellation thereof is not achieved well. This given value varies depending on various rolling conditions. However, the value can be predicted on the basis of the actual data of rolling, and can be selected by actually measuring the roll profile. Specific examples will be described later.

As a result, the wear profile having the growth rate of a wear depth suppressed or a constant wear depth maintained thereafter can be held.

Therefore, even after many rolling operations which were conventionally impossible because of large wear and a deteriorated working roll surface profile are performed, the cancellation effect can be always obtained between the wear and thermal expansion profiles, and the working roll profile becomes small in value. It is thus possible to keep a good plate profile constant, and good plate quality constant.

Figure 6A:
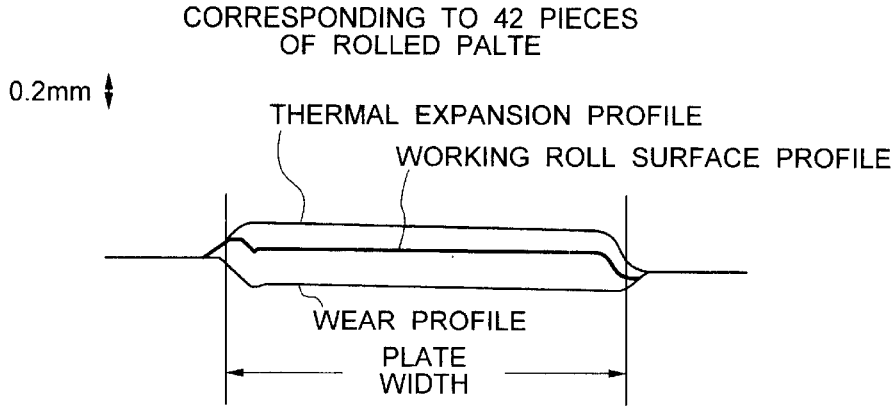
Figure 6B:
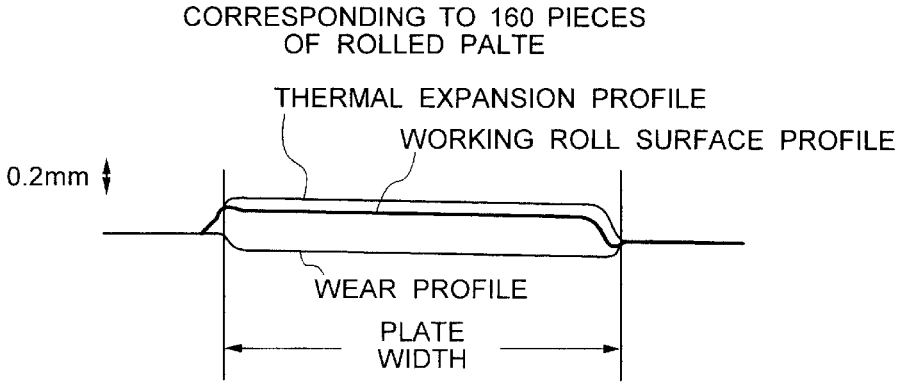

FIGS. 6A and 6B illustrate working roll surface profiles in the first embodiment of the invention when rolling is performed by moving the working roll 2 in the axial direction, and grinding the surface of the working roll by the grinder.

Figure 3A:
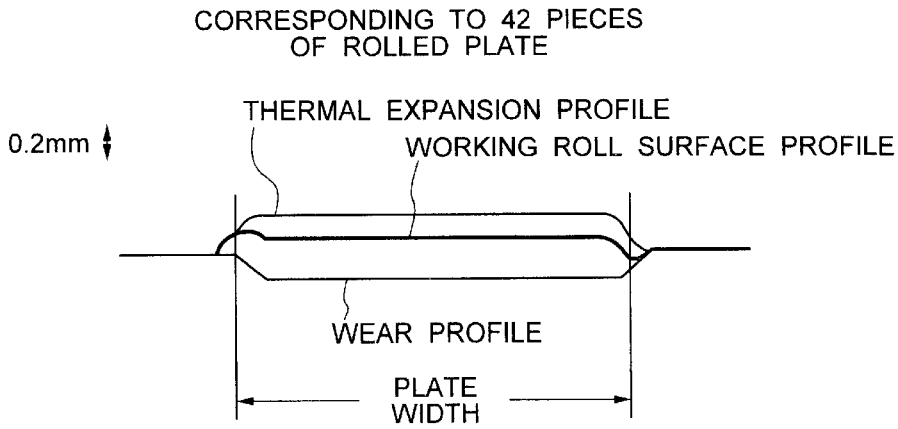
FIGS. 3A and 3B are views illustrating the occurrence of working roll surface profiles.
Figure 3B:
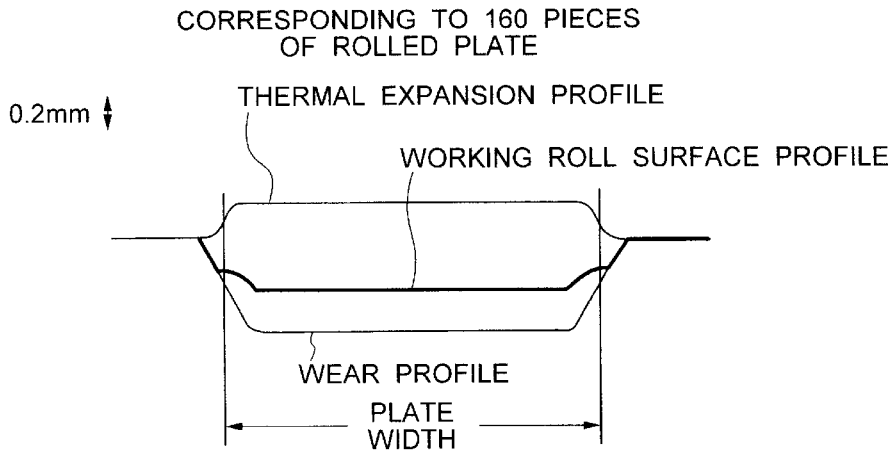
Figure 4A:
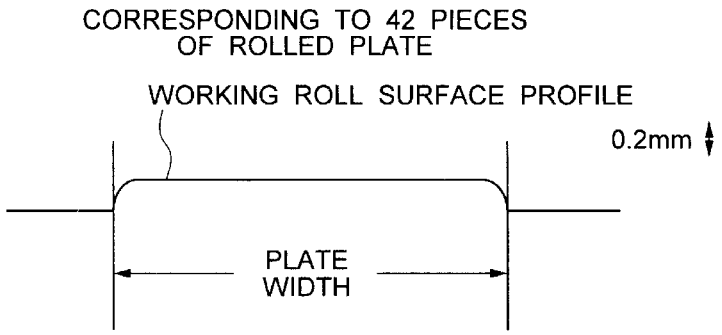
FIGS. 4A, 4B and 4C are views illustrating the occurrence of working roll surface profiles.
Figure 4B:
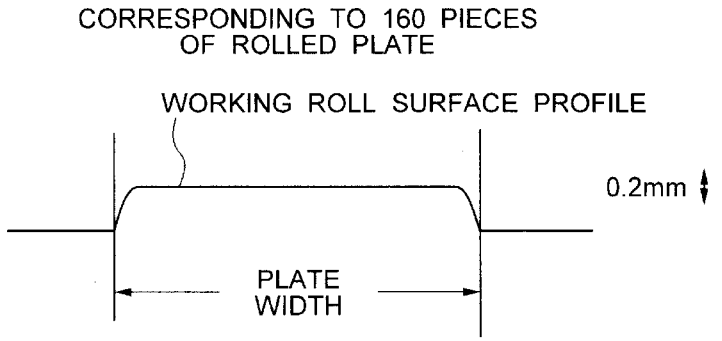
Figure 4C:
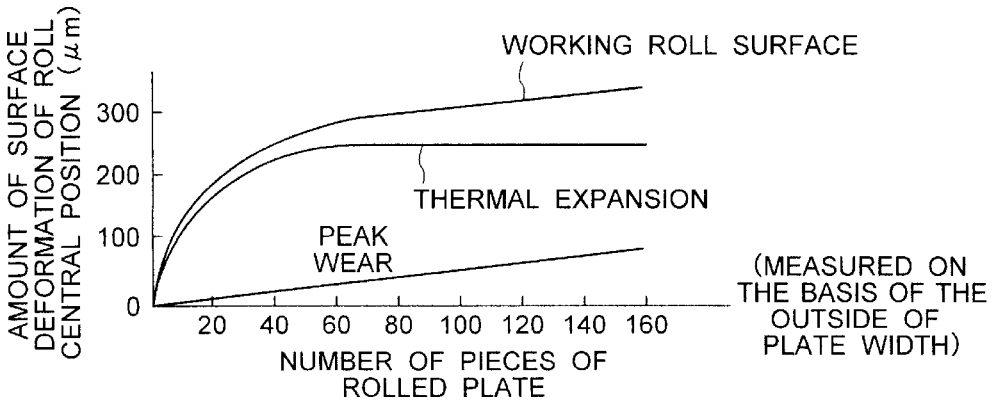
Figure 5A:
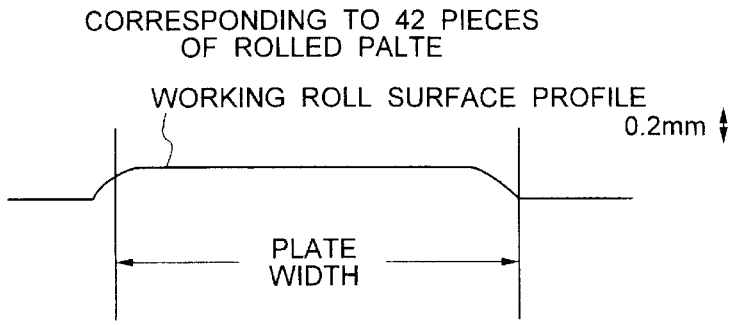
FIGS. 5A, 5B and 5C are views illustrating the occurrence of working roll surface profiles.
Figure 5B:
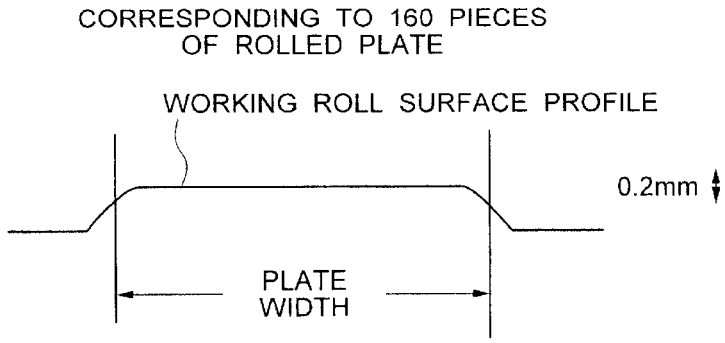
Figure 5C:
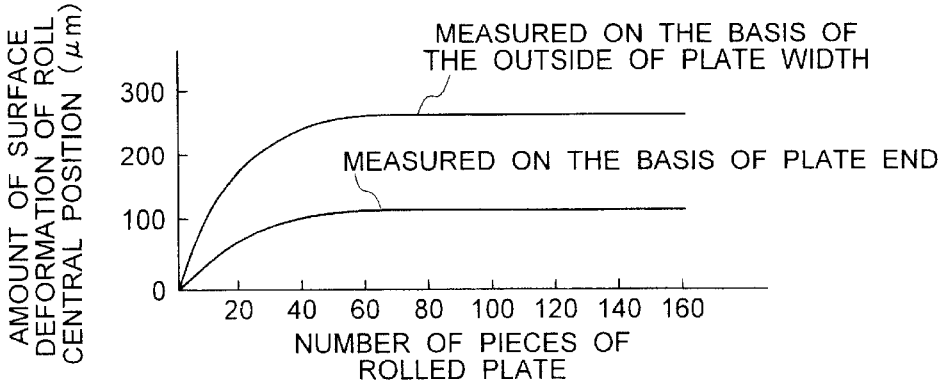

The working roll surface profiles shown in the drawings indicate a change per roll radius. Conditions for working roll shifting are similar to those described above with reference to FIG. 3A, i.e., an axial movement of 10 mm for every 2 rolls, and a maximum moving position of ±100 mm. In other words, the illustration is an example of successively shifting the working roll 2 by a specified amount.

After the rolling of 54 pieces of rolled plates, that is, at the time when the absolute value of the working roll wear profile reached substantially the absolute value of the thermal expansion profile of the working roll, the grinding of the working roll surface was performed for a working roll region located outside of a plate width which region was to be brought into contact with the plate during rolling operation performed thereafter, and the amount of grinding was set to be 3.15 $\mu$m/one rolling operation, which amount is substantially the same one as the amount of the wear of the working roll per one rolling operation, by which one rolling operation the steel plate was reduced in thickness at a rolling reduction of 25 to 35%. Thus, the profiles corresponding to 44 pieces of rolled plates in FIG. 6 occur under the influence of only the working roll shifting, wherein the cancellation effect occurs between the wear profile and the thermal expansion profile, and the surface profile is also small in value.

The profiles corresponding to 160 pieces of rolled plates in FIG. 6B are bought about by both the working roll shifting and the working roll surface grinding. It can be understood that even if the number of pieces of rolled plates is larger in comparison with that of FIG. 3A, the cancellation effect can be provided between the wear and thermal expansion profiles, and the surface profile is also maintained small in value. This is attributed to the fact that, by grinding the working roll surface by use of the grinder, it becomes possible to make the shape of the wear profile saturated which had increased without termination in the conventional technique, and to cancel the wear profile and the saturated thermal expansion profile with each other.

In other words, according to the invention, since the cancellation effect is maintained between the wear and thermal expansion profiles, it is possible to keep the working roll surface profile constant and small in value. As the upper and lower working rolls are located in point symmetry to the plate center, the profile of roll gaps symmetrical left and right is transferred to the plate, resulting in a good plate profile. Therefore, according to the invention, it is possible to keep the good profile of a plate to be manufactured constant, and plate quality constant. As a result, the time of using the working rolls can be extended, and good quality plates can be manufactured in a stable manner.

In addition, no end portion peak wear makes it unnecessary to perform excessively deep grinding, bringing about a cost advantage for roll use. Moreover, according to the invention, since the working roll surface can be kept constant and small in value, a limitation needed regarding the plate width order of the coffin schedule type is greatly relaxed, making it possible to freely select a rolling schedule even for considerably long-time rolling.

The embodiment of the invention has been described by taking the example of its application to the 4-high rolling mill. However, a similar effect can be obtained even with a 6-high rolling mill having working rolls, intermediate rolls and reinforcing rolls provided in a rolling stand, if it is arranged in such manners as the working rolls are axially movable and as a grinder for grinding the surface of each of the working rolls is provided. The 6-high rolling mill is not different in essence from the invention.

In the described embodiment of the invention, reference was made to the effect brought about in a case where the grinding is performed in the non-contact working roll region located outside of the plate width which region is to be in contact with the plate in the succeeding rolling operation performed thereafter, or in another region further including a more outside portion than the former region, or in the whole region located outside of the plate width. The working roll surface brought into contact with the plate 1 of each of the working rolls sometimes become rough in roughness due to its pressure-contact with the plate. Even in the case of grinding a rolling portion of the working roll so as to remove such a rough surface, an effect similar to that of the invention can be obtained by the steps of: grinding a plurality of times the non-contact working roll region located outside of the plate width which region is to be brought into contact with the plate 1 in succeeding rolling operation performed thereafter, or another region further including a more outside portion than the former region, or the whole of working roll region located outside of the plate width; and then grinding the rolling working roll region in pressure contact with the rolled plate. Thus, the case of this grinding is not different in essence from the invention. Similarly, there occurs such a case as surface roughness or irregular, angular wear surface is caused in the working roll surface periphery in contact with the plate end portion of the surface, or as irregular wear surface. Even in the case of grinding a boundary defined between the non-contact working roll region and the working roll wear region so as to make a gentle-sloping wear profile while removing the irregular wear surface, the same effect as that of the invention can be obtained by the steps of: grinding a plurality of times the non-contact working roll region located outside of the plate width which region is to be brought into contact with the plate 1 in succeeding rolling operation performed thereafter, or another region further including a more outside portion than the former region, or the whole working roll region located outside of the plate width; and then grinding the boundary region defined between the non-contact working roll region and the working roll wear region. Thus, the case of this grinding is not different in essence from the invention.

Figure 7A:
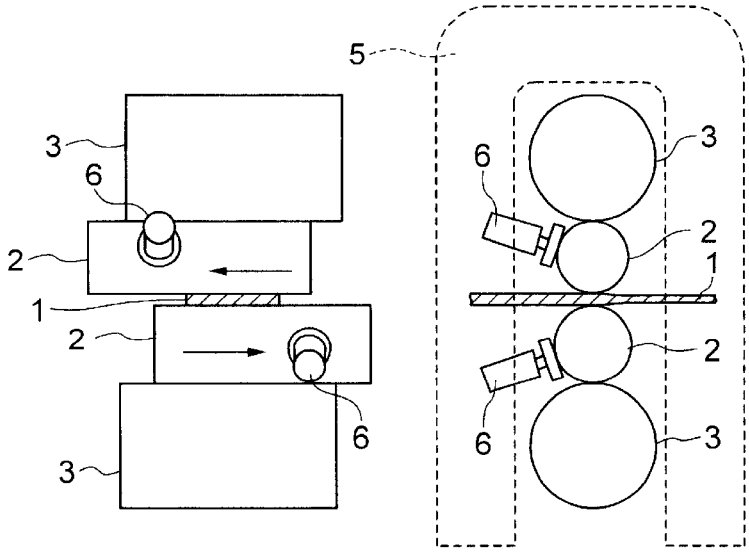
FIGS. 7A, 7B and 7C are views illustrating a mechanism and a roll profile according to the second embodiment of the invention.

The second embodiment of the invention will now be described by referring to FIGS. 7A, 7B and 7C. In FIG. 7A, a pair of working rolls 2 and reinforcing rolls 3 are provided in a rolling stand 5, the upper and lower working rolls 2 being movable in axial directions, and a grinder 6 is installed to grind the surface of each of the working rolls 2. The kind of the rolling, the dimensions of each of the working rolls and the grinder are the same ones as disclosed in the first embodiment.

Figure 7B:
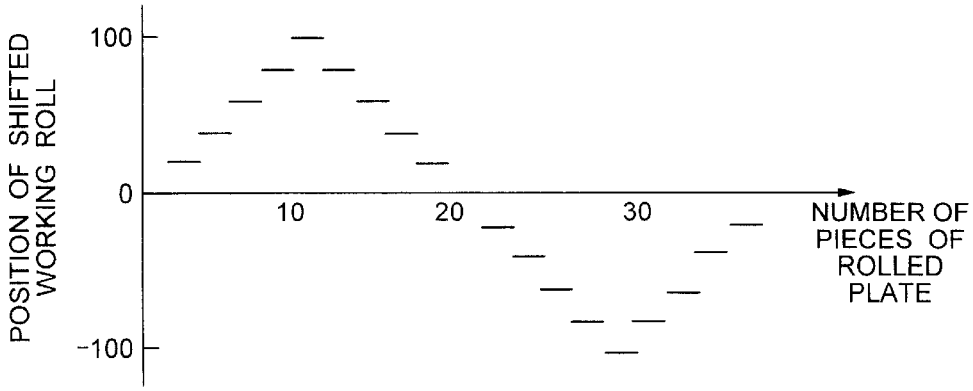
Figure 7C:
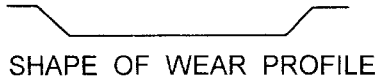

FIG. 7B shows a relation between a working roll shifting position and the number of pieces of rolled plates. The positions of the upper and lower working rolls 2 are moved by the same amounts in opposite axial directions for every 2 pieces of rolling coils. After the positions of the moved working rolls 2 reach maximum points, the working rolls 2 are moved again in opposite directions for every 1 piece of rolling coil or for every a plurality of pieces of rolling coils, the working rolls 2 are moved again in opposite directions after the moved working rolls again reach maximum points, and rolling is performed by repeating these operations. Accordingly, the movements of the working rolls 2 brings about a wear profile having a reverse trapezoidal shape as shown in FIG. 7C. However, this shape facilitates cancellation with a thermal expansion profile, increasing a cancellation effect.

Figure 8A:
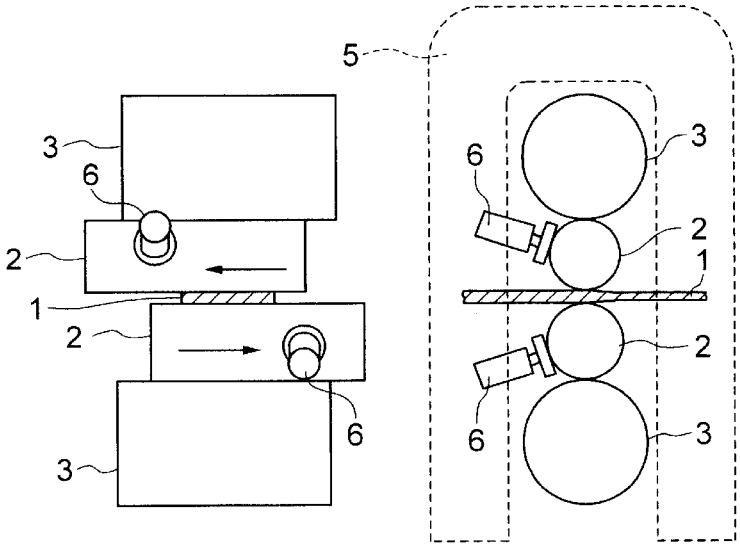
FIGS. 8A, 8B and 8C are views illustrating a mechanism and a roll profile according to the third embodiment of the invention.
Figure 8B:
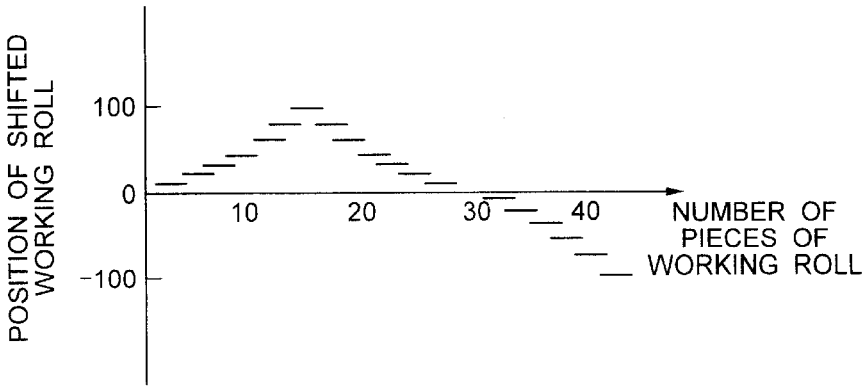
Figure 8C:
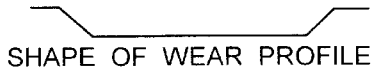

The third embodiment of the invention will now be described by referring to FIGS. 8A, 8B and 8C. An example of FIG. 8A indicates a modification of one moving amount of each of the upper and lower working rolls 2 of FIG. 7B. FIG. 8B shows a relation between a working roll shifting position and the number of pieces of rolled plates. The positions of the upper and lower working rolls 2 are moved in opposite axial directions for every 2 rolling coils (effects obtained are similar between every 1 rolling coil and a plurality of rolling coils, and there is no difference in essence from the invention). The amount of one movement of each of the working rolls 2 is made to be large when the moving position of the working roll is near a maximum point, and is made to be small when the moving position of the working roll is near the middle of the movement range. Accordingly, the movement of the working roll 2 facilitates the cancellation of the shape of a wear profile (shown in FIG. 8C) with the shape of a thermal expansion profile, further increasing the cancellation effect. Therefore, according to the invention, the effect of the cancellation between the wear and thermal expansion profiles is maintained, making it possible to keep a constant and small working roll surface profile. In this way, a good plate profile is obtained.

Therefore, according to the invention, the good and constant profile of a manufactured plate can be kept, and plate quality can be kept constant and good. As a result, the working rolls can be used for a long period of time, and good quality plates can be manufactured in a stable manner. In addition, since no end portion peak wear occurs, the necessity of performing excessively deep grinding can be avoided, and a cost advantage can be obtained for the roll use.

Furthermore, according to the invention, since the constant and small working roll surface profile can be maintained, a limitation occurring regarding the plate width order of the coffin schedule type can be greatly relaxed, making it possible to make a rolling schedule freely even for considerably long-time rolling.

The fourth embodiment of the invention will now be described by referring to FIG. 9.

Figure 9:
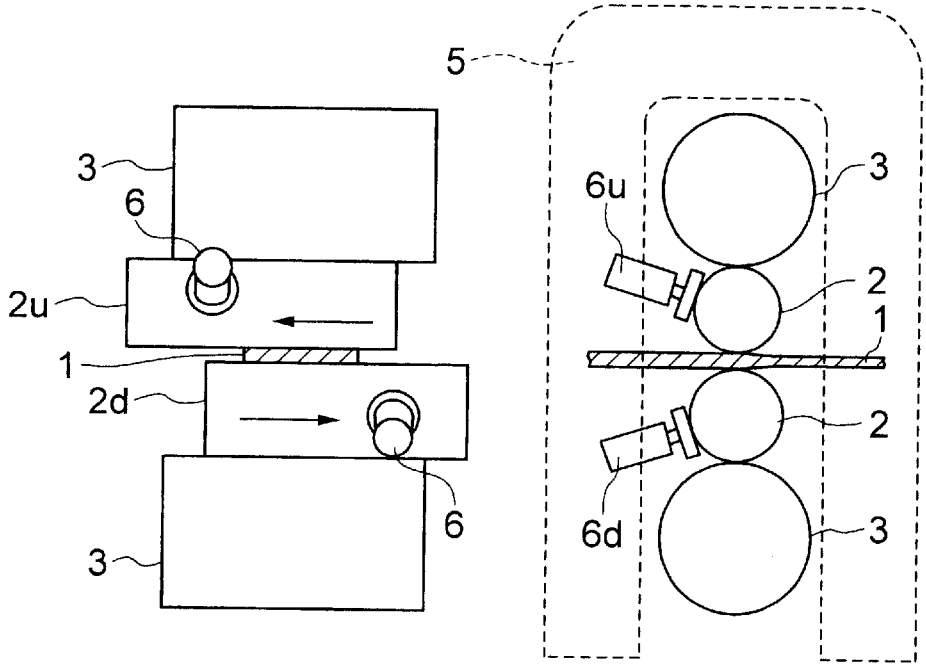
FIG. 9 is a view illustrating a mechanism according to the fourth embodiment of the invention.

In FIG. 9, a pair of working rolls 2 and reinforcing rolls 3 are provided in a rolling stand 5, the upper and lower working rolls 2 being movable in respective axial directions, grinders 6*u* and 6*d* are installed to grind upper and lower working roll surfaces 2*u* and 2*d*, respectively, and the amounts of grinding can be set to be different between the grinders (6*u* and 6*d*). The kind of the rolling, the dimensions of each of the working rolls and the grinder are the same ones as disclosed in the first embodiment.

According to this embodiment, the shape of end portion wear is dispersed as described above by changing the positions of the working rolls 2 and thereafter by performing the rolling, and the effect of the cancellation between a wear profile and a thermal expansion profile is obtained, forming a small working roll surface profile. Subsequently, the surface of each of the working rolls is ground by the grinder so that the wear profile is substantially saturated to have a constant shape, whereby the effect of the cancellation between the wear profile and the thermal expansion profile is thereby maintained, making it possible to maintain a constant and small working roll surface profile.

During rolling, if temperatures are different between the upper and lower surfaces of the plate 1, or if the upper and lower surfaces are different from each other in scale thickness, the amounts of wear or the amounts of thermal expansion are different between the upper and lower working rolls 2*u* and 2*d*, resulting in a difference in the sizes of working roll surface profiles between the upper and lower working rolls. Accordingly, the difference in the sizes of the working roll surface profiles between the upper and lower working rolls may cause deviation left and right in the plate profile in the positions of the shifted working rolls. According to the embodiment, the grinders 6*u* and 6*d* are further provided respectively to grind the upper and lower working roll surfaces 2*u* and 2*d*, and the amounts of grinding are made to be different between the grinders (6*u* and 6*d*). Deviation in the amounts of wear or the amounts of thermal expansion between the upper and lower rolls is thereby corrected, making it possible to correct deviation in the wear or thermal expansion profile.

Thus, deviation in the upper and lower working roll surface profiles caused by the deviation in the upper and lower wear or thermal expansion profiles during rolling can be corrected, and left and right deviation in the plate profile can be corrected. Hence, a more uniform and better plate profile is selected. Therefore, according to the invention, it is possible to keep constant the good profile of the manufactured plate and constant good plate quality.

The working rolls can be used for a long period of time, and good quality plates can be manufactured in stable manner. In addition, because of no end portion peak wear, the necessity of performing excessively deep grinding can be avoided, providing a cost advantage for the roll use. Further, according to the invention, since the working roll surface profile is also maintained constant and small, a limitation occurring on the plate width order of the coffin schedule type can be greatly relaxed, making it possible to make a rolling schedule freely even for considerably long-time rolling.

Figure 10:
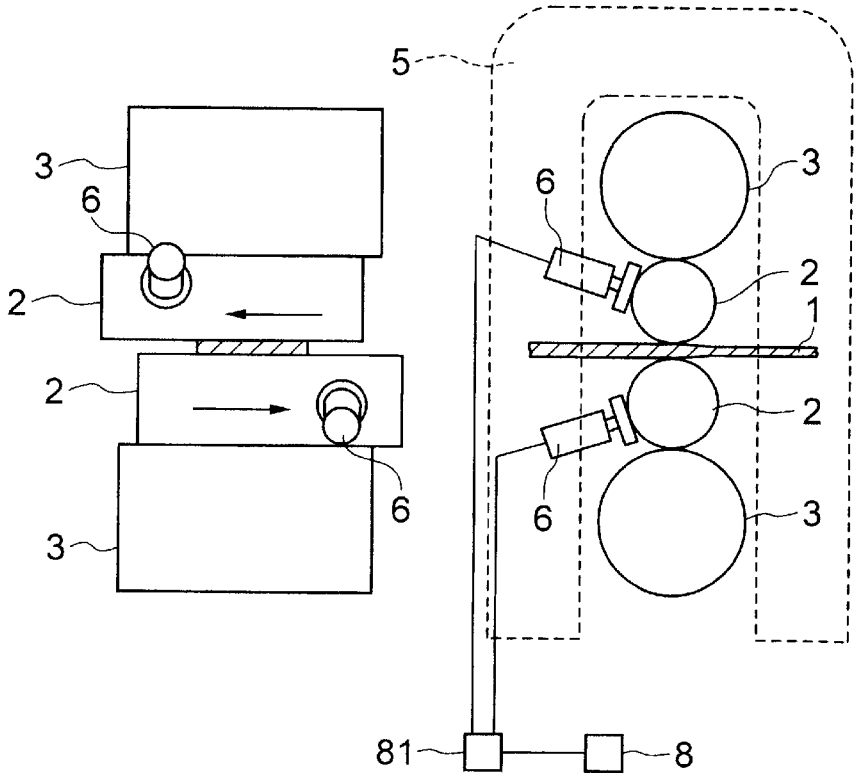
FIG. 10 is a view illustrating a mechanism according to the fifth embodiment of the invention.

The fifth embodiment of the invention will now be described by referring to FIG. 10. In FIG. 10, a pair of working rolls 2 and reinforcing rolls 3 are provided in a rolling stand 5, the upper and lower working rolls 2 being movable in respective axial directions, and a grinder 6 is installed to grind the surface of each of the working rolls 2. In addition, a storing and calculating means 8 is provided to store and calculate the number of pieces of rolled plates produced or the total amount of rolling performed after the replacement of the working roll (, that is, in a period of time continuing from the initial use of the working roll), and an instructing means 81 is installed to instruct the start of grinding for the working rolls when the predetermined number of pieces of rolled plates or amount of rolling is reached. In other words, a roll profile is estimated by use of the storing and calculating means and, by using the estimated value, a grinding command is sent to the grinder. The kind of the rolling, the dimensions of each of the working rolls and the grinder are the same ones as disclosed in the first embodiment.

In the described embodiment, the shape of the end portion wear is dispersed as described above by changing the positions of the working rolls 2 in the axial direction, forming a gentle-sloping wear profile. The effect of the cancellation with a thermal expansion profile is provided, and a surface profile also becomes small. The storing and calculating means 8 stores and calculates the number of pieces of rolled plates or the amount of rolling after working roll replacement (, that is, in a period of time continuing from the initial use of the working rolls). For example, regarding the number of pieces of the rolled plates, the inputting thereof may be made manually every each load signal or every rolling. The amount of rolling is obtained by measuring and calculating rolling loads and times. The rolling amount instructing means 81 instructs the commencement of the grinding of the working rolls when the predetermined number of pieces of rolled plates or amount of rolling is reached. Once the number of pieces of the rolled plates or the amount of rolling is obtained, the amount of wear on the surface of each of the working rolls is determined on the bases of the calculation or previous data obtained from actual values. Accordingly, the number of pieces of rolled plates or the amount of rolling corresponding to a proper wear amount may be set beforehand conversely. The working roll surface is ground by the grinder 6 upon receiving the command of grinding, and a wear profile can be saturated substantially to have a constant shape. Thus, the effect of cancellation can be maintained between the wear and thermal expansion profiles, and a working roll surface profile can also be kept constant and small in value.

Thus, the change of the working roll surface profile caused by the change of the wear profile during rolling can be suppressed, and hence a more uniform and better plate profile is obtained. Therefore, according to the invention, it is possible to keep constantly the good profile of the manufactured plate, and good plate quality. The working rolls can be used for a long period of time, and good quality plates can be manufactured in stable manner. In addition, because of no end portion peak wear, the necessity of performing excessively deep grinding is avoided, providing a cost advantage for the roll use. Moreover, according to the invention, it is possible to keep the working roll surface profile constant and small in value. Therefore, a limitation occurring regarding the plate width order of the coffin schedule type can be greatly relaxed, and a rolling schedule can be made freely even for considerably long-time rolling.

The sixth embodiment of the invention will now be described by referring to FIG. 11.

Figure 11:
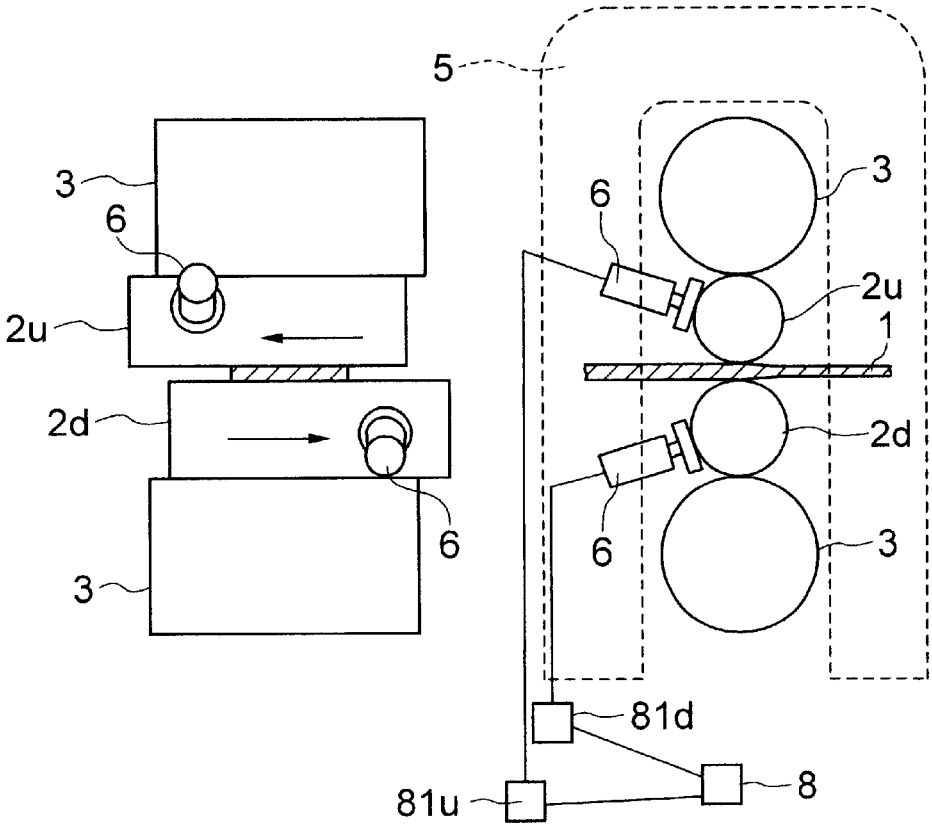
FIG. 11 is a view illustrating a mechanism according to the sixth embodiment of the invention.

In FIG. 11, a pair of working rolls 2 and reinforcing rolls 3 are provided in a rolling stand 5, the upper and lower working rolls 2*u* and 2*d* being movable in respective axial directions, and a grinder 6 is installed to grind the surface of each of the working rolls 2. In addition, a storing and calculating means 8 is provided to store and calculate the number of pieces of rolled plates produced or the amount of rolling performed after working roll replacement (, that is, in a period of time continuing from the initial use of the working roll), and instructing means 81*u* and 81*d* are installed to instruct the grinding of the working rolls when the number of rolled plates or the amount of rolling reached a predetermined value previously selected independently for the upper and lower working rolls 2*u* and 2*d*. In other words, the upper and lower working rolls 2*u* and 2*d* are controlled independently of each other. The kind of the rolling, the dimensions of each of the working rolls and the grinder are the same ones as disclosed in the first embodiment.

According to this embodiment, the shape of end portion peak wear is dispersed as described above by changing the location of the working rolls 2 in the axial direction prior to rolling. The effect of cancellation between wear and thermal expansion profiles is obtained, and a surface profile becomes small in value. The storing and calculating means 8 stores and calculate the number of pieces of rolled plates produced or the amount of rolling performed after the working roll replacement. The rolling amount instruction devices 81*u* and 81*d* instruct the grinding of the upper and lower working rolls 2*u* and 2*d* when the numbers of pieces of rolled plates or the amount of rolling reached the predetermined value. As described above, upon receiving the command of the grinding start, the grinder 6 grinds the working roll surface, and a wear profile can be saturated substantially to have a constant shape. Thus, the effect of cancellation between the wear and thermal expansion profiles can be maintained, and a working roll surface profile can also be kept constant and small in value. The change of the working roll surface profile caused by the change of the wear profile during rolling can be suppressed. During the rolling, if temperatures are different between the upper and lower surfaces of the plate 1 or the upper and lower surfaces are different from each other in scale thickness, the amounts of wear or the amounts of thermal expansion are different between the upper and lower working rolls 2*u* and 2*d*, resulting in a difference in the sizes of the wear or thermal expansion profiles between the upper and lower working rolls.

The difference in the sizes of working roll surface profiles between the upper and lower sides may cause deviation left and right in a plate profile at the position of the shifted working rolls. According to the invention, the instructing means 81*u* and 81*d* are further provided to instruct the grinding of the working rolls when the number of pieces of rolled plates or the amount of rolling reached a predetermined value selected independently for the upper and lower working rolls 2*u* and 2*d*. By instructing the respective grinders 6 to start the grinding independently, deviation in the amount of wear or thermal expansion between the upper and lower working rolls can be corrected, and hence the deviation of the wear or thermal expansion profiles can be corrected. Accordingly, deviation in the working roll surface profiles between the upper and lower sides caused by the deviation in the wear or thermal expansion profiles between the upper and lower working rolls during rolling can be corrected. Therefore, a more uniform and better plate is obtained.

Therefore, according to the invention, it is possible to keep constantly the good profile of a manufactured plate, and also to keep constant, good plate quality. Accordingly, the working rolls can be used for a long time, and good quality plates can be manufactured in stable manner. In addition, because of no end portion peak wear, the necessity of performing excessively deep grinding can be avoided, providing a cost advantage for the roll use. Moreover, according to the invention, since the constant and small working roll surface profile can be maintained, a limitation occurring regarding the plate width order of the coffin schedule type can be relaxed, and a rolling schedule can be made freely even for considerably long-time rolling.

Figure 12:
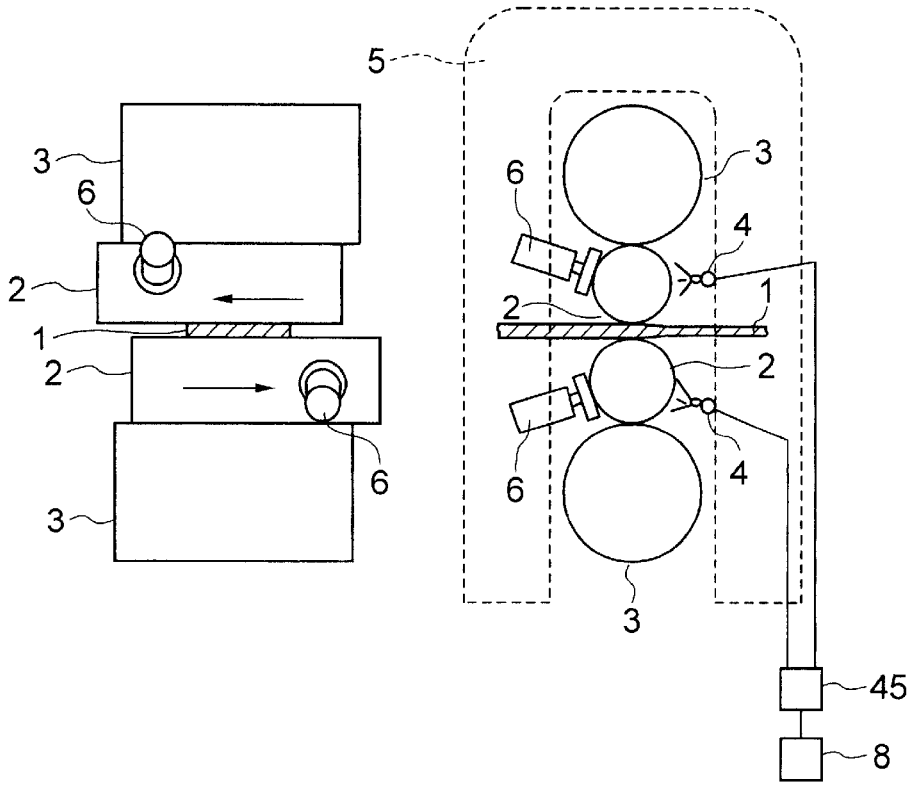
FIG. 12 is a view illustrating a mechanism according to the seventh embodiment of the invention.

The seventh embodiment of the invention will now be described by referring to FIG. 12. In FIG. 12, a pair of working rolls 2 and reinforcing rolls 3 are provided in a rolling stand 5, the upper and lower working rolls 2 being movable in respective axial directions, and a grinder 6 is installed to grind a non-contact working roll region located outside of a plate width which region is to be brought into contact with a plate during succeeding rolling operation performed thereafter, or a more outside region than the former region, or the whole of a non-contact working roll region located outside of the plate width. In addition, a working roll cooling means 4 is provided to jet cooling water onto the working rolls, storing and calculating means 8 being provided to store and calculate the number of rolled plates produced or the amount of rolling performed after working roll replacement, and a cooling water amount calculating unit 45 is installed to calculate the rate of cooling water in accordance with a predetermined number of pieces of the rolled plates or the amount of rolling. The structure of the working roll cooling means is disclosed in JP-A-55-81010 the disclosure of which is incorporated by reference herein. The kind of the rolling, the dimensions of each of the working rolls and the grinder are the same ones as disclosed in the first embodiment.

According to the described embodiment, the shape of the end portion peak wear is dispersed as described above by changing the positions of the working rolls 2 in the axial direction prior to performing rolling. The effect of the cancellation is obtained between the wear and thermal expansion profiles, and a surface profile becomes small in value. At a time when the wear depth of each of the working rolls reaches a given value, the grinder 6 grinds a non-contact working roll region located outside of the plate width which region is to be brought into contact with the plate 1 in the succeeding rolling operation performed thereafter, or another working roll region further including a more outside portion than the former region, or the whole working roll region located outside of the rolled plate. Accordingly, a wear profile having the growth rate of a wear depth limited or a wear depth kept constant thereafter can be held. If rolling is performed for various plates different from one another in plate thickness, plate width or rolling-force conditions, the thermal expansion amount of the working roll varied according to the rolling conditions. Thus, the thermal expansion amount may need to be corrected so that the thermal expansion and the wear profile may be cancelled each other. According to the embodiment of the invention, the storing and calculating means 8 stores and calculate the number of pieces of rolled plates produced or the amount of rolling performed after working roll replacement. For example, regarding the number of pieces of the rolled plates, the data thereof may be inputted manually every load signal or every rolling. The amount of rolling may be obtained by measuring and calculating a rolling load and the times thereof. The cooling-water rate-calculating means 45 calculates the thermal expansion amount of the working roll on the basis of the number of pieces of the rolled plates or the amount of rolling, the rate of cooling water being calculated according to the degrees of the thermal expansion and the amount of wear, and cooling water is jetted onto the working roll by the working-roll-cooling means 4. Once the amount of thermal expansion is obtained, the rate of cooling water is determined on the basis of calculation or previous data obtained from actual values. Accordingly, the effect of the cancellation between the wear and thermal expansion profiles is maintained, making it possible to keep a constant, small working roll surface profile. Thus, the change of the working roll surface profile caused by the change of the thermal expansion profile can be suppressed. As a result, a more uniform and better quality plate is obtained.

Therefore, according to the invention, it is possible to keep a good profile constant for a manufactured plate, and to obtain constant, good plate quality. Thus, the working rolls can be used for a long time, and good quality plates can be manufactured in a stable manner. In addition, because of no end portion peak wear, the necessity of performing excessively deep grinding can be avoided, providing a cost advantage for the roll use. Moreover, according to the embodiment, since the working roll surface profile can also be kept constant and small in value, a limitation occurring regarding the plate width order of the coffin schedule type can be greatly relaxed, and a rolling schedule can be made freely even for considerably long-time rolling.

Figure 13:
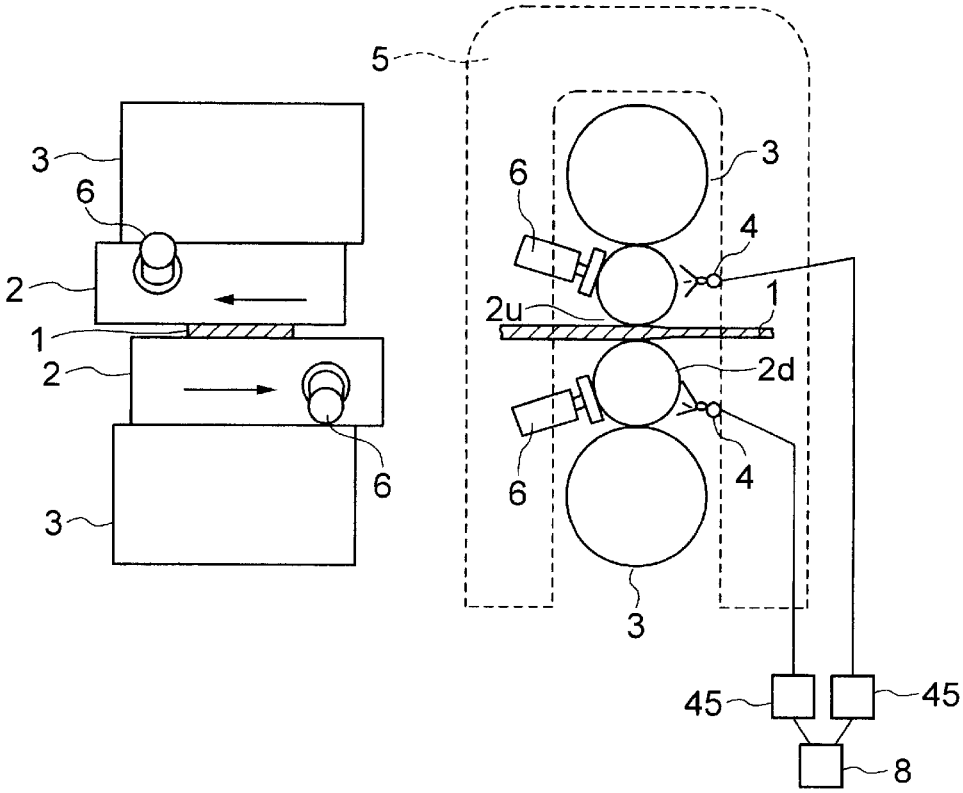
FIG. 13 is a view illustrating a mechanism according to the eighth embodiment of the invention.

The eighth embodiment of the invention will now be described by referring to FIG. 13. In FIG. 13, the cooling-water rate-calculating means 45 shown in FIG. 12 is adapted to compute the rate of cooling water independently for each of the upper and lower working rolls 2*u* and 2*d*, and to jet cooling water onto each of the upper and lower working rolls 2*u* and 2*d* on the basis of the obtained amount of the cooling water. Other elements are the same as disclosed in the seventh embodiment.

In a case of rolling various plates different from one another in thickness, width and/or rolling force conditions, the thermal expansion amount of the working rolls varies according to the rolling conditions. Thus, the amount of thermal expansion may need to be corrected so that the cancellation of the wear and thermal expansion profiles may become possible. In addition, in cases where temperatures are different between the upper and lower surfaces of a plate, or where the upper and lower surfaces are different in scale thickness, the amounts of wear or thermal expansion are different between the upper and lower working rolls 2*u* and 2*d*, resulting in a difference in the amounts of working roll wear and thermal expansion profiles between the upper and lower working rolls. Thus, since a difference also occurs in working roll surface profiles between the upper and lower working rolls, deviation left and right may occur in a plate profile at the position of shifted working rolls. According to the embodiment of the invention, the storing and calculating means 8 store and calculate the number of pieces rolled plates produced or the amount of rolling performed after working roll replacement. For example, regarding the number of pieces of the rolled plates, it may be inputted manually every load signal or every rolling. As regards the amount of rolling, it may be obtained by measuring and calculating a rolling load and the times of rolling. The cooling-water rate-calculating means 45 calculate the amount of thermal expansion for each of the upper and lower working rolls 2*u* and 2*d* on the basis of the number of pieces of the rolled plates or the amount of rolling, and then calculate the rate of cooling water on the basis of the thermal expansion amounts of the upper and lower working rolls 2*u* and 2*d*, and cooling water is jetted onto the upper and lower working rolls 2*u* and 2*d* by the working roll-cooling means 4. Once the amount of thermal expansion is determined, the rate of cooling water is obtained from the calculation or from previous data obtained from actual values. Accordingly, the effect of the cancellation between the wear and thermal expansion profiles is maintained in fine manner, making it possible to also keep a working roll surface profile constant and small in value. Moreover, deviation in the upper and lower working roll surface profiles caused by deviation in the upper and lower thermal expansion profiles can be corrected, and left and right deviation in the plate profile can be corrected.

Therefore, the change of the working roll surface profile caused by the change of the thermal expansion profile during rolling can be suppressed. As a result, a more uniform and good plate profile can be obtained.

Figure 14A:
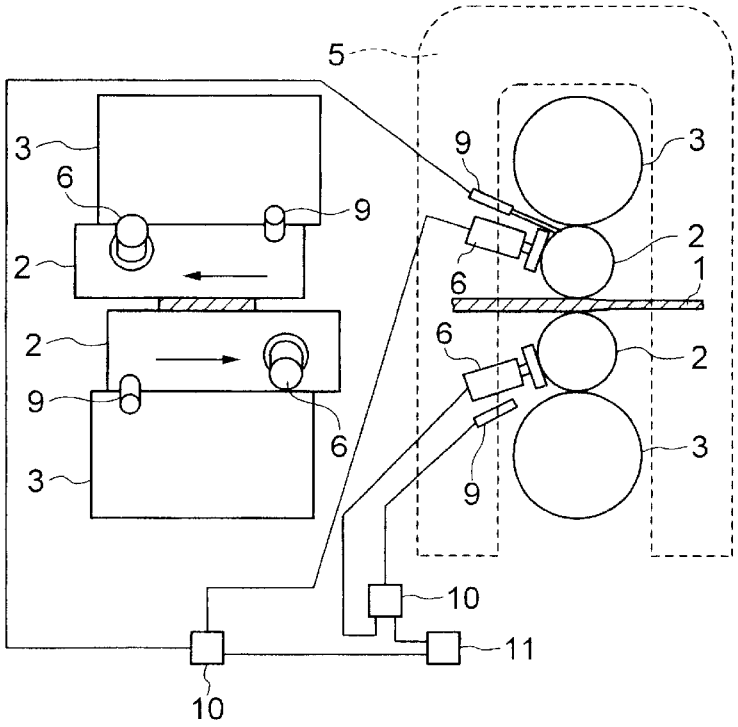
FIG. 14 is a view illustrating a mechanism according to the ninth embodiment of the invention.
Figure 14B:
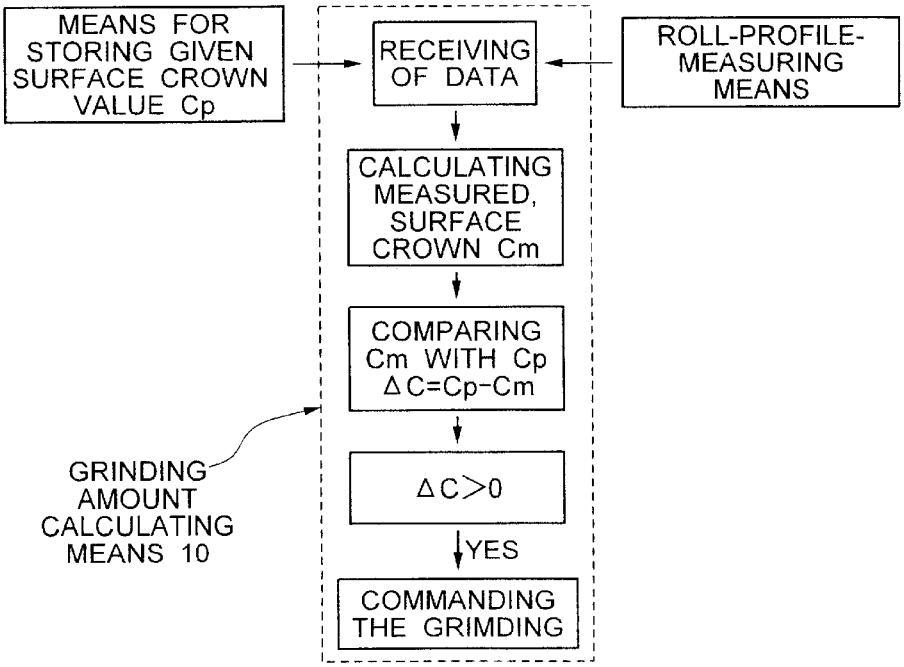

The ninth embodiment of the invention will now be described by referring to FIG. 14. In FIG. 14, a pair of working rolls 2 and reinforcing rolls 3 are provided in a rolling stand 5, the upper and lower working rolls 2 being movable in respective axial directions, and a grinder 6 is installed to grind a non-contact working roll region located outside of a plate width which region is to be in contact with the plate in the succeeding rolling operation performed thereafter, or another working roll region further including a more outside portion than the former region, or the whole working roll region located outside of the plate width. In addition, profile-measuring means 9 are provided in the rolling stand so as to measure the surface profile of the working rolls 2, and grinding-amount-calculating means 10 are installed to compute the amounts of grinding for the working roll surfaces on the basis of the measured profiles. The structure of the profile-measuring means is disclosed in JP-B-2708351. The kind of the rolling, the dimensions of each of the working rolls and the grinder are the same ones as disclosed in the first embodiment.

According to the described embodiment, the shape of end portion peak wear is dispersed as described above by changing the positions of the working rolls 2 in the axial directions prior to rolling. The effect of the cancellation is obtained between wear and thermal expansion profiles, and a surface profile becomes small in value. At a time when the wear depth of the working roll reaches a given value, the grinder 6 grinds a non-contact working roll region located outside of the plate width which region is to be brought into contact with the plate in the succeeding rolling operation performed thereafter, or another working roll region including a more outside portion than the former region, or the whole working roll region located outside of the plate width. Accordingly, a wear profile having the growth rate of a wear depth suppressed or a wear depth kept constant after the grinding can be held. The effect of the cancellation between the wear and thermal expansion profiles is maintained, making it possible to also keep a working roll surface profile constant and small in value. According to the embodiment, in addition, the profile measuring device 9 measures a surface profile, and the grinding-amount-calculating means 10 calculate the amount of grinding for the working roll surface on the basis on the measured profile. Then, the grinder 6 grinds the surface of each of the working rolls 2. The specific steps thereof are explained below.

A targeted surface crown Cp (difference between a value of working roll surface profile corresponding to the plate center portion and another value thereof in the vicinity of the plate end portion) of a working roll 2 is inputted to a surface crown storing means 11, and it is stored therein. A working roll surface profile is measured by the profile-measuring means 9 and, in the grinding-amount-calculating means 10, upon receiving a signal of the measured profile, the measured surface crown Cm (difference between a value of working roll surface profile corresponding to the plate center portion and another value thereof in the vicinity of the plate end portion) is calculated, and this difference ΔC is then calculated by the following equation:

$$\Delta C = Cp - Cm \tag{1}$$

No treatments explained below are performed if ΔC is a negative value.

If the value of ΔC is positive, then a command signal for grinding the outside of a plate path is outputted to the grinder 6. Upon having received the signal, the grinder 6 grinds the surface of the working roll 2. Then, the profile-measuring means 9 measures a surface profile, the surface of the working roll 2 being ground, and these operations are repeated. The steps explained above are shown in FIG. 14B.

Thus, since the targeted surface crown Cp of the working roll 2 is thus maintained during the rolling, the variation of the working roll surface profile can be corrected even if any variation occurs in the profile of the working roll surface due to certain external disturbances. Hence, a uniform and good plate profile is obtained. Therefore, according to the invention, it is possible to keep the constant, good profile of a manufactured plate, and also constant good plate quality.

Thus, the working rolls can be used for a long time, and good quality plates can be manufactured in stable manner. In addition, because of no end portion peak wear, the necessity of performing excessively deep grinding can be avoided, providing a cost advantage for the roll use. Moreover, according to the invention, since the working roll surface profile can also be maintained constant and small in value, a limitation occurring regarding the plate width order of the coffin schedule type can be greatly relaxed, and a rolling schedule can be made freely even for considerably long-time rolling.

Figure 15:
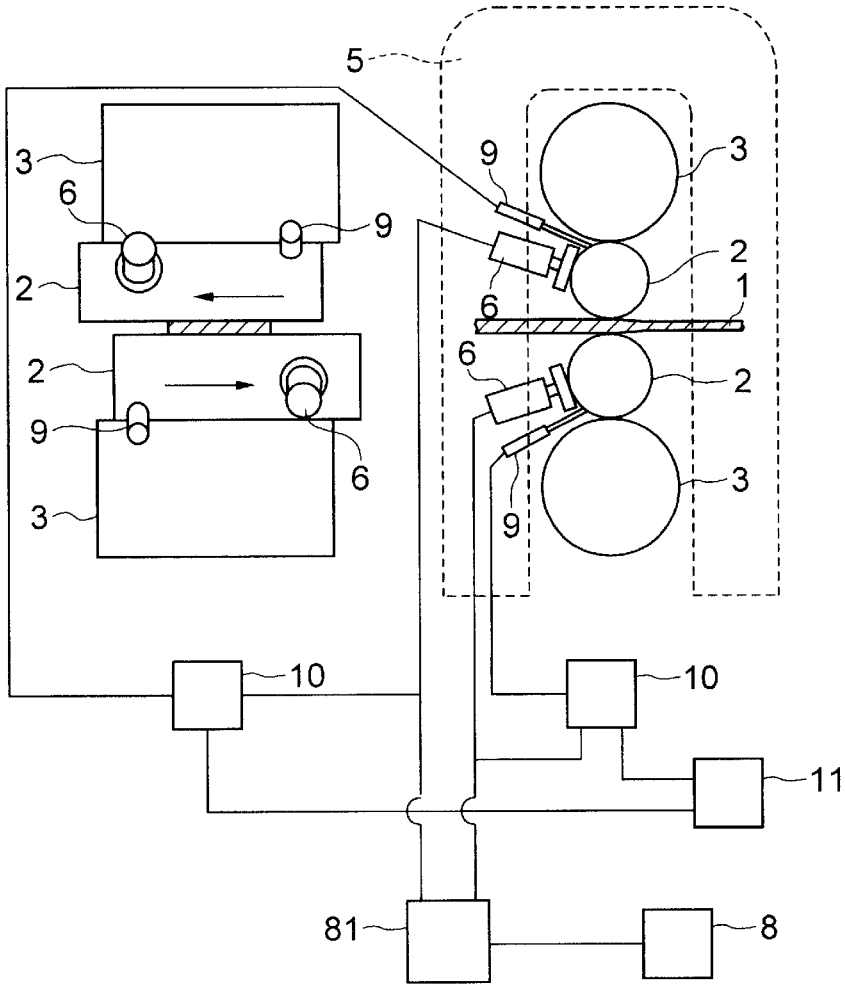
FIG. 15 is a view illustrating a mechanism according to the tenth embodiment of the invention.

The tenth embodiment will now be described by referring to FIG. 15. In FIG. 15, a pair of working rolls 2 and reinforcing rolls 3 are provided in a rolling stand 5, the upper and lower working rolls 2 being movable in respective axial directions, and a grinder 6 is installed to grind the surface of each of the working rolls 2. In addition, storing and calculating means 8 are provided to store and calculate the number of pieces of rolled plates produced or the amount of rolling performed after working roll replacement, and an instructing means 81 is installed to instruct the grinding start of each working roll when the number of rolled plates or amount of rolling reaches a predetermined value. Further, a profile-measuring-means 9 is provided in the rolling stand to measure the surface profile of each of the working rolls 2, and a grinding-amount-calculating means 10 is installed to obtain the grinding amount of the working roll surface on the basis of the measured profile. The kind of the rolling, the dimensions of each of the working rolls, the grinder and the profile-measuring means are the same ones as disclosed in the ninth embodiment.

According to the described embodiment, the shape of the end portion peak wear is dispersed as described above by shifting the positions of the working rolls 2 in the axial directions prior to rolling. The effect of the cancellation is provided between wear and thermal expansion profiles, and the surface profile becomes small in value. The storing and calculating means 8 store and calculate the number of pieces of rolled plates produced or the amount of rolling performed after the working roll replacement. When the number of pieces of the rolled plates or amount of rolling reaches a predetermined value, the rolling-amount-calculating means 81 instructs the grinding start of each of the working rolls. Upon receiving the command of grinding start, the grinder 6 grinds the working roll surface, whereby the wear profile can be saturated substantially in a constant shape. Accordingly, the effect of the cancellation between the wear and thermal expansion profiles is maintained, and a working roll surface profile can also be maintained constant and small in value. In addition, according to the embodiment of the invention, the profile-measuring-means 9 measures the surface profile, the grinding-amount-calculating means 10 calculates the grinding amount of the working roll surface on the basis of the measured profile, and then the grinder grinds the surface of each of the working rolls 2. Similarly to the process described above with reference to FIG. 14, the targeted surface crown Cp of the working roll 2 is inputted to the surface profile-storing means 11, and it is stored therein. The surface profile is measured by the profile-measuring device 9. Then, in the grinding-amount-calculating means 10, upon receiving the signals of the measured profile, a measured surface crown Cm (difference between a value of working roll surface profile corresponding to the plate center portion and another value thereof in the vicinity of the plate end portion) is obtained, and this difference ΔC=Cp−Cm is calculated. If the value of ΔC is negative, no succeeding treatments are performed. If the value of ΔC is positive, then a command signal for grinding the working roll region located outside of a plate path is outputted to the grinder 6. Upon having received the signal, the grinder 6 grinds the surface of the working roll 2. Then, the working roll surface profile is measured by the profile measuring device 9, and on the basis of the measured values the surface of the working roll 2 is again ground, and these operations are repeated.

Thus, since the targeted surface crown Cp of the working roll 2 is thus maintained during rolling, the variation of the working roll surface profile can be corrected even if the variation occurs in the profile of the working roll surface due to certain external disturbances. Hence, a uniform and good plate profile is obtained. Therefore, according to the embodiment of the invention, it is possible to keep the constant, good profile of a manufactured plate, and also constant, good plate quality. Thus, the working rolls can be used for a long time, and good quality plates can be manufactured in stable manner. In addition, because of no end portion peak wear, the necessity of performing excessively deep grinding can be avoided, providing a cost advantage for the roll use. Further, according to the embodiment of the invention, since the working roll surface profile can also be kept constant and small in value, a limitation occurring regarding the plate width order of the coffin schedule type can be greatly relaxed, and a rolling schedule can be made freely even for considerably long-time rolling.

The eleventh embodiment of the invention will now be described by referring to FIG. 16.

Figure 16:
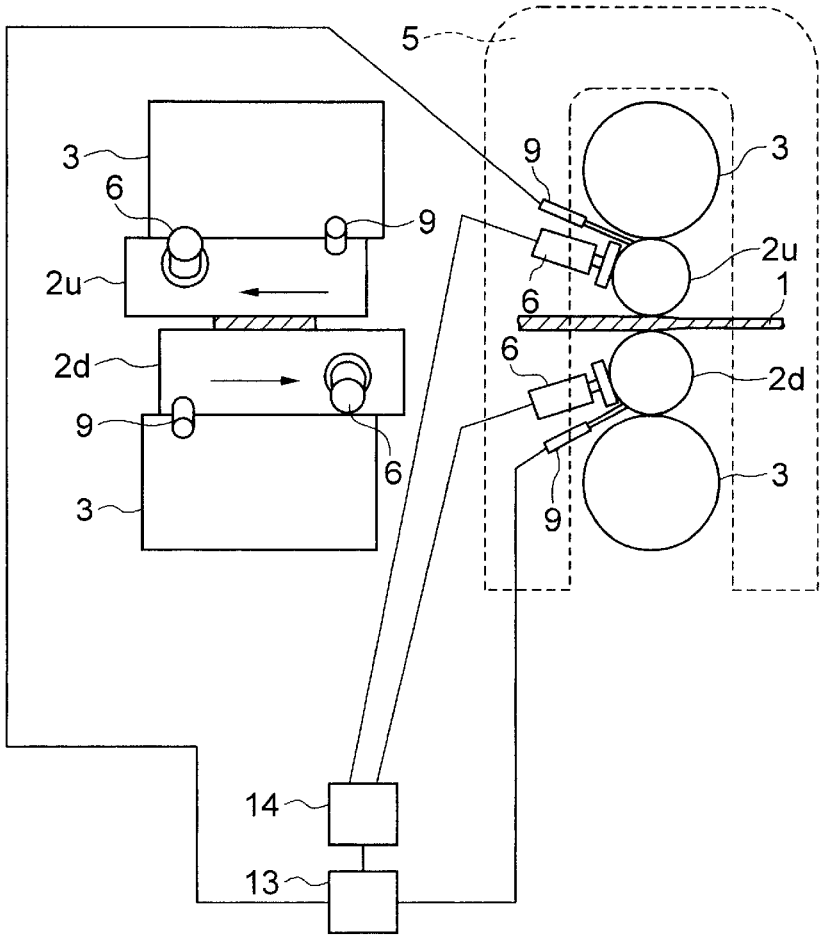
FIG. 16 is a view illustrating a mechanism according to the eleventh embodiment of the invention.

FIG. 16 illustrates a hot rolling mill according to the eleventh embodiment of the invention. In this case, the hot rolling mill comprises a grinder for grinding the surface of each of working rolls, the working rolls being movable in axial directions, a profile-measuring means provided in a rolling stand, a deviation-component calculating means for calculating left and right deviation components on the basis of measured upper and lower working roll profiles, and a grinding-amount-calculating means for obtaining the amounts of grinding respectively for the upper and lower working roll surfaces on the basis of the obtained deviation components.

In FIG. 16, upper and lower working rolls 2*u* and 2*d* and reinforcing rolls 3 are in a rolling stand 5, the upper and lower working rolls 2*u* and 2*d* being movable in respective axial directions, and a grinder 6 is installed to grind the surface of each of the working rolls 2. A profile-measuring device 9 is provided in the rolling stand to measure the surface profile of each of the working roll 2. A deviation component-calculating means 13 is provided to calculate the deviation components on the basis of measured upper and lower working roll profiles, and a grinding amount-calculating means 14 is installed to obtain the amounts of grinding respectively for the upper and lower working roll surfaces on the basis of the obtained deviation components. The kind of the rolling, the dimensions of each of the working rolls, the grinder and the profile-measuring means are the same ones as disclosed in the ninth embodiment.

According to the described embodiment, the shape of the end portion peak wear is dispersed as described above by shifting the positions of the upper and lower working rolls 2*u* and 2*d* in the axial directions prior to rolling. The effect of the cancellation is provided between the wear and thermal expansion profiles, and a surface profile becomes small in value. Then, each of the working roll surfaces is ground by the grinder, and the wear profile is saturated substantially to have a constant shape. Thereby, the effect of the cancellation between the wear and thermal expansion profiles can be maintained, and working roll surface profile can also be kept constant and small in value. According to the embodiment, in addition, the surface profile is measured by the profile measuring means 9. The deviation components are computed by the deviation component-calculating means 13 on the basis of the measured profiles of the upper and lower working rolls 2*u* and 2*d* and, on the basis of the obtained deviation components, the amounts of grinding are calculated respectively for the upper and lower working rolls 2*u* and 2*d* by the grinding-amount-calculating means 14. Then, each of the upper and lower working rolls 2*u* and 2*d* are ground by the grinder 6. The specific steps are explained below.

A working roll surface profile is measured by the profile-measuring means 9. In the deviation component-calculating means 13, upon receiving the signals of the measured surface profile, the surface crown Cmu (difference between a value of working roll surface profile corresponding to the plate center portion and another value thereof in the vicinity of the plate end portion) of the upper working roll 2*u* and the surface crown Cmd difference between a value of working roll surface profile corresponding to the plate center portion and another value thereof in the vicinity of the plate end portion) of the lower working roll 2*d* are obtained. Then, a difference ΔC between these surface crowns is obtained, and each deviation component ΔC is outputted to the grinding amount-calculating means 14.

$$\Delta C = Cmu - Cmd \tag{2}$$

In the grinding amount-calculating means 14, if the value of ΔC is positive, it is judged that much wear occurs in the lower working roll 2*d*, and a command signal for grinding the lower working roll region located outside of the plate path is outputted to the grinder 6. Upon receiving this signal, the grinder 6 grinds the surface portion of the lower working roll 2*d*.

If the value of ΔC is negative, it is judged that much wear occurs in the upper working roll 2*u*, and another command signal for grinding the upper working roll region located outside of the plate path is outputted to the grinder 6. Upon receiving this signal, the grinder 6 grinds the surface portion of the upper working roll 2*u*. Then, the surface profile is measured by the profile-measuring means 9, the surfaces of the upper and lower rolls 2*u* and 2*d* being then ground on the basis of the measured values, and these operations are repeated.

Since the surface crowns of the upper and lower working rolls 2*u* and 2*d* are maintained in the substantially same level between the upper and lower sides during rolling, the surface profile variations of the upper and lower working rolls can be corrected even if the variations occur in the profiles of the upper and lower working roll surfaces due to certain external disturbances such as a wear difference between the upper and lower working rolls. Accordingly, a uniform and good plate profile is obtained at any positions of the shifted working rolls. Thus, according to the embodiment of the invention, it is possible to keep constant, good profile of a manufactured plate, and also constant good plate quality.

Thus, the working rolls can be used for a long time, and good quality plates can be manufactured in stable manner. In addition, because of no end portion peak wear, the necessity of performing excessively deep grinding can be avoided, providing a cost advantage for the roll use. Moreover, according to the embodiment of the invention, since the working roll surface profile can be maintained to be constant and small in value, a limitation occurring regarding the plate width order of the coffin schedule type can be greatly relaxed, and rolling schedule can be made freely even for considerably long-time rolling.

The twelfth embodiment of the invention will now be described by referring to FIG. 17.

Figure 17:
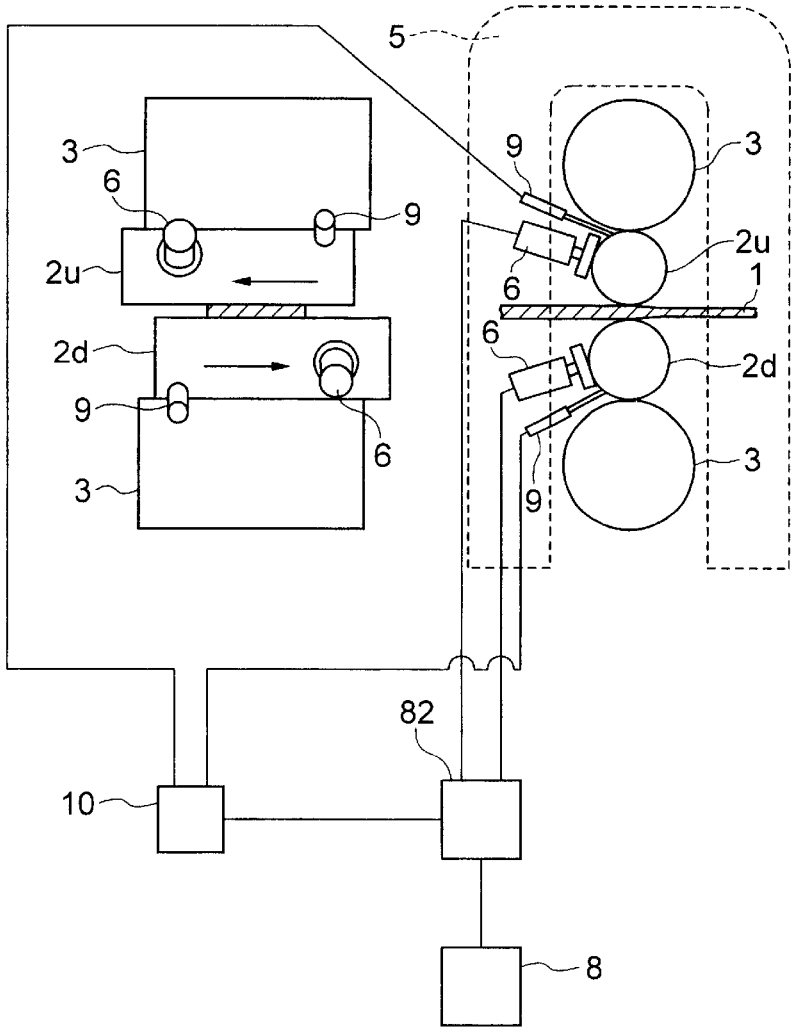
FIG. 17 is a view illustrating a mechanism according to the twelfth embodiment of the invention.

In FIG. 17, upper and lower working rolls 2*u* and 2*d* and reinforcing rolls 3 are provided in a rolling stand 5, the upper and lower working rolls 2*u* and 2*d* being movable in respective axial directions, and a grinder 6 is installed to grind the surface of each of the working rolls 2. In addition, a profile-measuring means 9 is provided in the rolling stand to measure the surface profile of each of the working rolls 2, and a deviation component-calculating means 13 is provided to calculate left and right deviation components on the basis of the measured upper and lower working roll profiles. Further, a storing and calculating means 8 is provided to store and calculate the number of pieces of rolled plates produced or the amount of rolling performed after the working roll replacement, and an instructing means 82 is installed to instruct grinding start respectively for the upper and lower working rolls on the basis of a predetermined number of rolls or amount of rolling and the obtained deviation components. The kind of the rolling, the dimensions of each of the working rolls, the grinder and the profile-measuring means are the same ones as disclosed in the ninth embodiment.

According to the described embodiment, the shape of the end portion peak wear is dispersed as described above by changing the positions of the upper and lower working rolls 2*u* and 2*d* in the axial directions prior to rolling. The effect of the cancellation is obtained between the wear and thermal expansion profiles, and the working roll surface profile becomes small in value. According to the embodiment, the profile-measuring means 9 measures the surface profile, and the deviation component-calculating means 13 calculates left and right deviation components on the basis of the measured profiles of the upper and lower working rolls 2*u* and 2*d*. Then, the storing and calculating means 8 stores and calculates the number of pieces of rolled plates produced or the amount of rolling performed after the working roll replacement. Upon receiving the signal of left and right deviation components from the deviation component-calculating means 13, the rolling amount-instructing means 82 corrects the predetermined number of pieces of the rolled plates or amount of rolling regarding each of the upper and lower working rolls 2*u* and 2*d*. Since the wear amount of the working roll surface is obtained on the basis of the calculation or the previously obtained data based on actual values, the number of pieces of the rolled plates or the rolling amount which is corrected in correspondence to a proper wear correction amount may be set beforehand conversely. When the number of pieces of the rolled plates or the amount of rolling reaches the predetermined value, the grinding start of each of the upper and lower working rolls 2*u* and 2*d* is instructed. Upon receiving the command of grinding start, the grinder 6 grinds each of the upper and lower working rolls 2*u* and 2*d*, and the surface profiles of the upper and lower working rolls 2*u* and 2*d* can be saturated substantially to have constant shapes. Thus, the effect of the cancellation between the wear and thermal expansion profiles is maintained, and the working roll surface profile can also be kept constant and small in value.

Accordingly, the surface profile changes of the upper and lower working rolls can be corrected even if variations occur in the profiles of the upper and lower working roll surfaces due to certain external disturbances such as a wear difference between the upper and lower working rolls. Hence, a uniform and good plate profile is obtained even at any positions of the shifted working rolls. Therefore, according to the embodiment of the invention, it is possible to keep the constant, good profile of a produced plate, and also constant good plate quality. Thus, the working rolls can be used for a long time, and good quality plates can be manufactured in stable manner. In addition, because of no end portion peak wear, the necessity of performing excessively deep grinding can be avoided, providing a cost advantage for the roll use. Moreover, according to the embodiment of the invention, since the working roll surface profile can also kept constant and small in value, a limitation occurring regarding the plate width order of the coffin type schedule can be greatly relaxed, and a rolling schedule can be made freely even for considerably long-time rolling.

The thirteenth embodiment of the invention will now be described by referring to FIG. 18.

Figure 18:
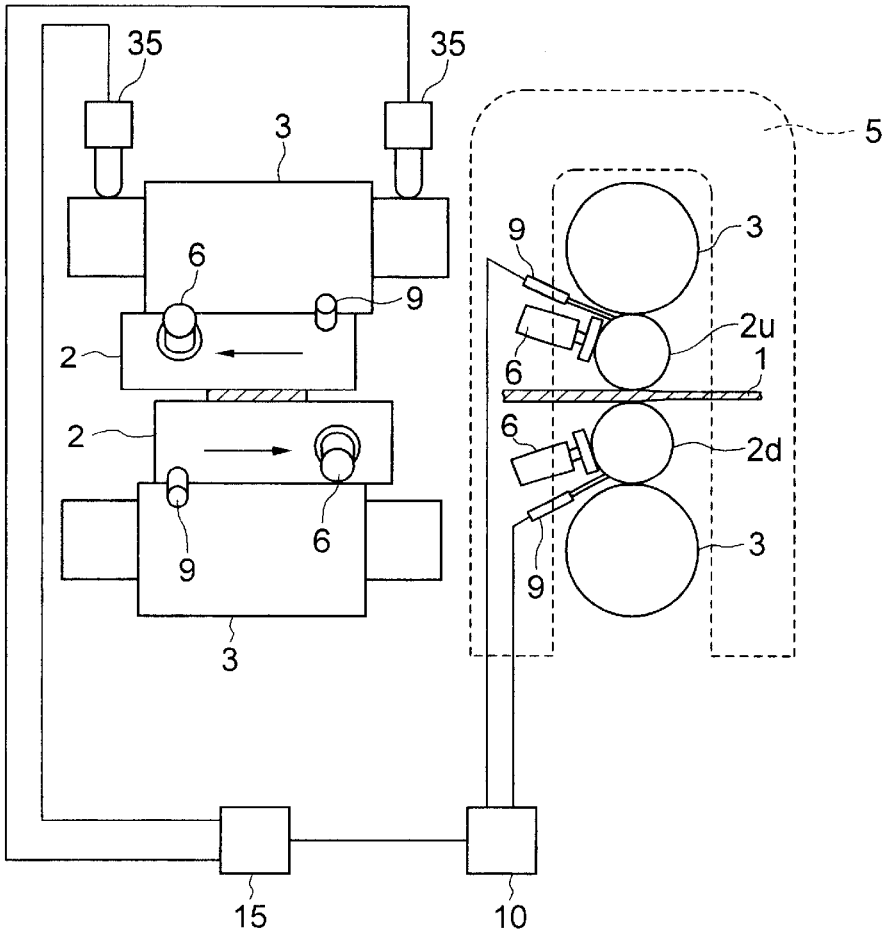
FIG. 18 is a view illustrating a mechanism according to the thirteenth embodiment of the invention.

FIG. 18 illustrates a hot rolling mill according to the thirteenth embodiment of the invention. In this case, the hot rolling mill comprises a grinder for grinding the surface of each of working rolls, the working rolls being movable in axial directions, a profile-measuring means provided in a rolling stand, a deviation-component-calculating means for calculating left and right deviation components on the basis of measured upper and lower working roll profiles, and rolling-and-correcting amount-calculating means for calculating left-and-right rolling, correcting amounts on the basis of the obtained deviation components. In the drawing, working rolls 2 and reinforcing rolls 3 are provided in a rolling stand 5, the working rolls 2 being movable in respective axial directions, and a grinder 6 is installed to grind the surface of each of the working rolls 2. A profile-measuring means 9 is provided in the rolling stand so as to measure the surface profile of each of the working rolls 2. A deviation component-calculating means 10 is provided to calculate the left and right deviation components on the basis of the measured upper and lower working roll profiles, and a rolling, correcting amount calculating means 15 is installed to obtain the left and right rolling, correcting amounts on the basis of the deviation components. The kind of the rolling, the dimensions of each of the working rolls, the grinder and the profile-measuring means are the same ones as disclosed in the ninth embodiment.

According to the described embodiment, the shape of the end portion peak wear is dispersed as described above by changing the positions of the working rolls 2 in the axial directions prior to rolling. The effect of the cancellation is provided between the wear and thermal expansion profiles, and a surface profile becomes small in value. Then, the surface of each of the working rolls is ground by the grinder, and the wear profile is saturated substantially to have a constant shape. The effect of the cancellation between the wear and thermal expansion profiles is thereby maintained, making it possible to keep a working roll surface profile constant and small in value. In addition, according to the invention, the profile-measuring means 9 measures the surface profile, and the deviation component-calculating means 10 calculates the left and right deviation components on the basis of the measured profiles of the upper and lower working rolls 2*u* and 2*d*. Then, the rolling, correcting amount-calculating means 15 obtains the left and right rolling, correcting amounts on the basis of the obtained deviation components, and the rolling means 35 corrects the left and right rolling amounts. Specific steps regarding the process are explained below.

The surface profile is measured by the profile measuring means 9. In the deviation component-calculating means 10, upon receiving the signals of the deviation components, the surface crown Cmu (difference between a value of working roll surface profile corresponding to the plate center portion and another value thereof in the vicinity of the plate end portion) of the measured upper working roll 2*u* and the surface crown Cmd (difference between a value of working roll surface profile corresponding to the plate center portion and another value thereof in the vicinity of the outside of the plate end portion) of the lower working roll 2*d* are calculated. This difference ΔC is obtained, and a deviation component ΔC=Cmu−Cmd is outputted to the rolling, correcting amount-calculating means 15. In the rolling, correcting amount-calculating means 15, rolling and correcting signals are outputted to the rolling, correcting means 35. In the rolling and correcting device 35, upon receiving the signals, left and right rolling amounts are corrected.

Accordingly, the surface profile variations of the upper and lower rolls can be corrected even if variations occur in the profiles of the upper and lower working roll surfaces due to certain external disturbances such as a wear difference between the upper and lower working rolls. Thus, a uniform and good plate is obtained at any positions of the shifted working rolls. Therefore, according to the embodiment of the invention, it is possible to keep constant, good profile of a manufactured plate, and also constant good plate quality. Thus, the working rolls can be used for a long time, and good quality plates can be manufactured in stable manner. In addition, because of no end portion peak wear, the necessity of performing excessively deep grinding can be avoided, providing a cost advantage for the roll use. Moreover, according to the invention, since the working roll surface profile can also be kept constant and small in value, the limitation occurring regarding the plate width order of the coffin schedule type can be greatly relaxed, and a rolling schedule can be made freely even for considerably long-time rolling.

The fourteenth embodiment of the invention will now be described by referring to FIG. 19.

Figure 19:
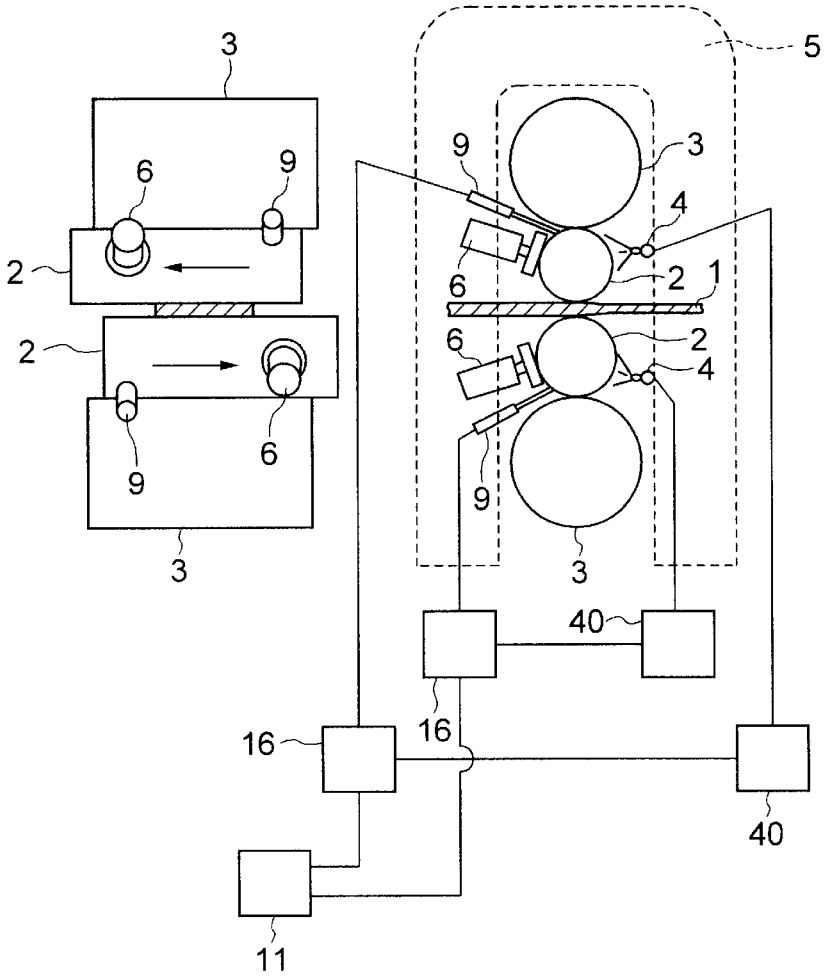
FIG. 19 is a view illustrating a mechanism according to the fourteenth embodiment of the invention.

FIG. 19 illustrates a hot rolling mill according to the fourteenth embodiment of the invention. In this case, the hot rolling mill comprises a grinder for grinding a surface of each of working rolls, the working rolls being movable in axial directions, a profile-measuring means provided in a rolling stand, a working roll-cooling means for jetting cooling water to the working rolls, and a cooling water-calculating means for obtaining the rate of cooling water on the basis of a measured profile. In the drawing, a pair of working rolls 2 and reinforcing rolls 3 are provided in a rolling stand 5, the upper and lower working rolls 2 being movable in respective axial directions, and a grinder 6 is installed to grind the surface of each of the working rolls. A profile-measuring means 9 is provided in the rolling stand 5 so as to measure the surface profile of each of the working rolls 2. A working roll-cooling device 4 is provided to jet cooling water to the working rolls. A cooling water-calculating means 16 is installed to obtain the rate of cooling water on the basis of the measured profile. The kind of the rolling, the dimensions of each of the working rolls, the grinder and the profile-measuring means are the same ones as disclosed in the ninth embodiment, and the working roll-cooling means is the same one as disclosed in the seventh embodiment.

According to the described embodiment, the shape of the end portion peak wear is dispersed as described above by changing the positions of the working rolls 2 in the axial directions prior to rolling. The effect of the cancellation is provided between wear and thermal expansion profiles, and a surface profile becomes small in value. Then, the grinder grinds the surface of each of the working rolls, and the wear profile is saturated substantially to have a constant shape. The effect of the cancellation between the wear and thermal expansion profiles is thereby maintained, making it possible to also keep a working roll surface profile constant and small in value. Further, according to the embodiment of the invention, the profile-measuring means 9 measures the surface profile, the cooling water-calculating means 16 obtaining the rate of cooling water on the basis of the measured profile, and the working roll-cooling means 14 jets cooling water through a water amount-adjusting means 40 onto the working rolls 2. Specific steps are explained below.

The targeted surface crown Cp (difference between a value of working roll surface profile corresponding to the plate center portion and another value near a plate end portion) of each of the working rolls 2 is inputted into a surface crown-storing means 11 so that it may be stored therein. Then, the working roll surface profile is measured by the profile-measuring means 9. In the cooling water-calculating means 16, upon receiving the signals of the measured surface profile, a measured surface crown Cm (difference between a value of working roll surface profile corresponding to the plate center portion and another value near a plate end portion) is obtained, and the difference ΔC is calculated in the following equation:

$$\Delta C = Cp - Cm \tag{3}$$

If the value of ΔC is positive, no succeeding operation is performed.

If the value of ΔC is negative, then a command signal is outputted to the water amount-adjusting means 40. In the water amount-adjusting means 40, upon receiving the signal, cooling water is jetted onto the working rolls 2 by the working roll-cooling means 4. Then, the surface profile is measured by the profile-measuring means 9, cooling water is jetted onto the working rolls 2, and these operations are repeated.

Since the targeted surface crown Cp of each of the working rolls 2 is thus maintained during rolling, the variation of the working roll surface profile can be corrected even if any variation occurs in the profile of the working roll surface due to certain external disturbances such as the variation of a thermal expansion amount. A uniform and good plate profile is accordingly obtained. Thus, according to the embodiment of the invention, it is possible to keep the constant, good profile of a manufactured plate, and also constant good plate quality. Therefore, the working rolls can be used for a long time, and good quality plates can be manufactured in stable manner. In addition, because of no end portion peak wear, the necessity of performing excessively deep grinding can be avoided, providing a cost advantage for the roll use. Moreover, according to the invention, since the working roll surface profile can also be kept constant and small in value, the limitation occurring on the plate width order of the coffin schedule type can be greatly relaxed, and a rolling schedule can be made freely even for considerably long-time rolling.

The fifteenth embodiment of the invention will now be described by referring to FIG. 20.

Figure 20:
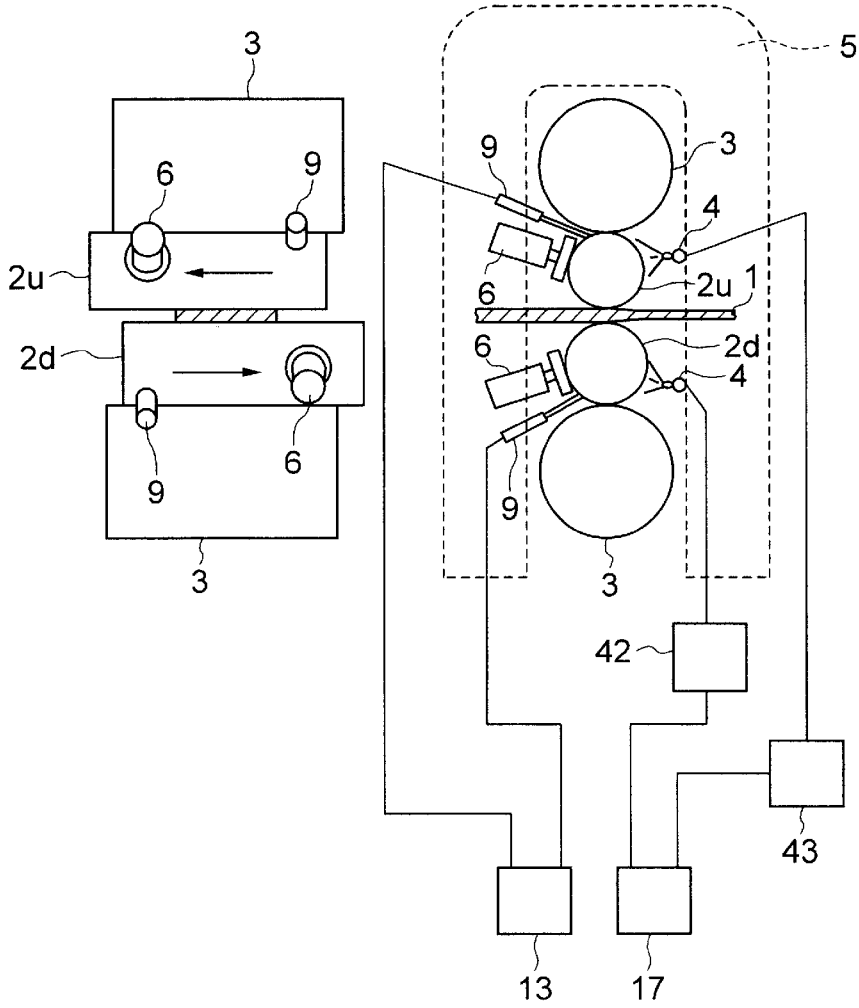
FIG. 20 is a view illustrating a mechanism according to the fifteenth embodiment of the invention.

FIG. 20 illustrates a hot rolling mill according to the fifteenth embodiment of the invention. In this case, the hot rolling mill comprises a grinder for grinding the surface of each of working rolls, the working rolls being movable in axial directions, a profile-measuring means provided in a rolling stand, a working roll-cooling means for jetting cooling water to the working rolls, a deviation component-calculating means for calculating deviation components on the basis of the measured profiles of the upper and lower working rolls, and a cooling-water-rate-calculating means for obtaining the rates of cooling water respectively for the upper and lower working rolls on the basis of the obtained deviation components. In the drawing, upper and lower working rolls 2*u* and 2*d* and reinforcing rolls 3 are provided in a rolling stand 5, the upper and lower working rolls 2*u* and 2*d* being movable in respective axial directions, and a grinder 6 is installed to grind the surface of each of the working rolls 2. A profile-measuring means 9 is provided in the rolling stand so as to measure the surface profile of each of the working rolls 2. A working roll-cooling means 4 is provided to jet cooling water onto the working rolls 2. A deviation component-calculating means 13 is provided to calculate left and right deviation components on the basis of the measured upper and lower working roll profiles. A cooling water-calculating means 17 is installed to obtain the rates of cooling water respectively for the upper and lower working rolls on the basis of the obtained deviation components. The kind of the rolling, the dimensions of each of the working rolls, the grinder, the profile-measuring means and the working roll-cooling means are the same ones as disclosed in the fourteenth embodiment.

According to the described embodiment, the shape of the end portion peak wear is dispersed as described above by changing the positions of the upper and lower working rolls 2*u* and 2*d* in the axial directions prior to rolling. The effect of the cancellation is provided between the wear and thermal expansion profiles, and a surface profile becomes small in value. Then, the working roll surface is ground by the grinder, and the wear profile is saturated substantially to have a constant shape. The effect of the cancellation between the wear and thermal expansion profiles is thereby maintained, and the working roll surface profile can also be kept constant and small in value. Further, according to the embodiment of the invention, the profile-measuring means 9 measures the surface profile, and the deviation component-calculating means 13 calculates left and right deviation components on the base of the measured profiles of the upper and lower working rolls 2*u* and 2*d*. Then, the cooling water rate-calculating means 17 obtains the rates of cooling water respectively for the upper and lower working rolls 2*u* and 2*d* on the basis of the obtained deviation components, and the working roll-cooling means 4 jets cooling water through water rate-adjusting means 42 and 43 onto the upper and lower working rolls 2*u* and 2*d*. The specific steps for the process are explained below.

The surface profile is measured by the profile-measuring device 9. In the deviation component-calculating means 13, upon receiving the signals of the measured profile, the measured surface crown Cmu (difference between a value of working roll profile corresponding to the plate center portion and another value thereof near the plate end portion) of the upper working roll 2*u* and the surface crown Cmd (difference between a value of the working roll profile corresponding to the plate center portion and another value thereof in the vicinity of the outside of the plate end portion) of the lower working roll 2*d* are obtained. This difference ΔC is calculated, and a deviation component ΔC is outputted to the cooling water rate-calculating means 17.

$$\Delta C = Cmu - Cmd \tag{4}$$

In the cooling water rate-calculating means 17, correcting amount corresponding to the deviation ΔC is equally transferred to the upper and lower working rolls 2*u* and 2*d*, and are outputted to the water rate-adjusting means 43 and 42. The water rate-adjusting device 43 calculates the correction amount ΔQu of the water rate by using the following equation on the basis of the deviation ΔC.

$$\Delta Qu = 0.5\Delta C/(\partial C/\partial Qu) \tag{5}$$

In this case, (∂C/∂Qu) may be obtained beforehand on the basis of the calculation or experiment.

In the water rate-adjusting means 43, upon receiving the signal, cooling water is jetted onto the upper working roll 2*u* by the working roll-cooling means 4.

The water rate-adjusting means 42 calculates the correction amount ΔQd of the water rate by using the following equation on the basis of the deviation ΔC.

$$\Delta Qd = -0.5\Delta C/(\partial C/\partial Qd) \tag{6}$$

In this case, (∂C/∂Qd) may be obtained beforehand on the basis of calculation or experiment.

In the water rate-adjusting means 43, upon receiving the signal, cooling water is jetted onto the lower working roll 2*d* by the working roll-cooling means 4.

Subsequently, the surface profile is measured by the profile-measuring means 9, bending forces being applied to the upper and lower working rolls 2*u* and 2*d*, and these operations are repeated.

Then, the surface profile is measured by the profile-measuring means 9, cooling water being jetted onto the upper and lower working rolls 2*u* and 2*d*, and these operations are repeated.

Since the surface crowns of the upper and lower working rolls 2*u* and 2*d* are thus maintained to have the substantially same value between the upper and lower working roll sides during rolling, the surface profile variations of the upper and lower working rolls can be corrected even if variations occur in the surface profiles of the upper and lower working rolls due to certain external disturbances such as a thermal expansion difference between the upper and lower working rolls. Thus, a uniform, good plate profile is obtained at any positions of the shifted working rolls. Therefore, according to the embodiment of the invention, it is possible to keep the constant, good profile of a manufactured plate, and also constant good plate quality. Thus, the working rolls can be used for a long time, and good quality plates can be manufactured in stable manner. In addition, because of no end portion peak wear, the necessity of performing excessively deep grinding can be avoided, providing a cost advantage for the roll use. Moreover, according to the embodiment of the invention, since the working roll surface profile can also be kept constant and small in value, the limitation occurring regarding the plate width order of the coffin schedule type can be greatly relaxed, and a rolling schedule can be made freely even for considerably long-time rolling.

According to the embodiment of the invention, even after many times of rolling are performed which could not have been performed in the prior arts due to the deteriorated working roll surface profile caused by much wear, the effect of the cancellation between the wear and thermal expansion profiles is always obtained, so that the working roll profile is small in value, the constant, good plate profile being obtained, and the constant, good quality plate is obtained.

Further, in the embodiment of the invention, the working rolls can be used for a long time, and good quality plates can be manufactured in stable manner. In addition, because of no end portion peak wear, the necessity of performing excessively deep grinding can be avoided, providing a cost advantage for the roll use. Moreover, according to the invention, since the working roll surface profile can also be kept constant and small in value, the limitation occurring on the plate width order of the coffin schedule type can be greatly relaxed, and a rolling schedule can be made freely even for considerably long-time rolling.

According to the embodiment of the invention, it becomes possible to correct the deviations of the upper and lower working roll surface profiles which deviation occurs due to the deviations of the upper and lower working roll wear and thermal expansion profiles during rolling, and to correct left and right deviation components occurring in the plate profile. Thus, a more uniform, good plate profile can be obtained.

Further, according to the embodiment of the invention, even in a case where the working roll surface profiles are varied due to any disturbance, it is possible to correct the variation of the working roll surface profiles, so that a uniform, good plate profile can be obtained.

The embodiments of the invention have been described by the taking the example of its application to the 4-high rolling mill. However, a similar effect can be obtained by a 6-high rolling mill including working rolls, intermediate rolls and reinforcing rolls provided in the rolling stand, and the use of the 6-hig rolling mill is within the essence of the invention.

As apparent from the foregoing, the present invention is advantageous in that a rolling mill and a rolling method capable of obtaining a uniform plate thickness distribution and capable of manufacturing good quality plates can be provided.

What is claimed is:

1. A rolling mill for producing a plate, comprising a rolling stand, at least one pair of upper and lower working rolls provided in said rolling stand which working rolls are movable in a direction toward a driving side of said rolling mill and in another direction reverse to the former direction each of which working rolls is moved in a direction reverse to each other, grinding means provided in the rolling stand which grinding means grinds a surface of said working rolls, means for storing and calculating a cumulative number of pieces of rolled plate produced or an amount of rolling performed in a period of time continuing from initial use of said working rolls, and grinding-instructing means for instructing the grinding means to perform grinding of the working rolls when said number of pieces of said rolled plate or the amount of said rolling reaches a given value.

2. A rolling mill according to claim 1, wherein a number of pieces of rolled plates at which number said grinding is commenced or an amount of rolling at which amount said grinding is commenced is previously set regarding each of said working rolls, and wherein said grinding-instructing means instructs said grinding means to independently perform the grinding of each of said upper and lower working rolls when rolling operation reaches said previously set number of pieces of said rolled plates or said previously set amount of rolling.

3. A rolling mill according to claim 1, further comprising profile-measuring means for measuring a profile of a working roll surface which means is provided in said rolling stand, and means for instructing said grinding means to perform grinding of the working roll in compliance with the measured profile of said working rolls.

4. A rolling method for rolling a plate by a rolling mill having at least a pair of upper and lower working rolls in a rolling stand, comprising the steps of:

moving the working rolls in axial directions;

grinding a surface of each of the working rolls by a grinder;

calculating the number of pieces of rolled plate or a rolling amount by a storing and calculating means; and commencing grinding of each of the working rolls when the number of pieces of the rolled plate produced or the amount of rolling performed after replacement of the working roll reaches a given value predetermined on the basis of calculation or previously obtained data based on actual values.

5. A rolling method according to claim 4, wherein in the step of commencing the grinding of the working rolls, the given value regarding the number of pieces of rolled plate or the amount of rolling is set for the upper and lower working rolls independently of each other, and the grinding of the upper and lower working rolls is commenced independently of each other when the numbers of pieces of rolled plates or the amount of the rolling reaches the given value.

6. A rolling method according to claim 4, further comprising the steps of the calculating rates of cooling water for each of the upper and lower working rolls independently, and jetting the cooling water to the upper and lower working rolls on the basis of the calculated rates of cooling water.

7. A rolling method according to claim 4, wherein a profile of a surface of each or of the working rolls is measured, and the grinding of the working roll is commenced on the basis of the measured working roll profile.

8. A method of rolling a plate by use of a rolling mill comprising a rolling stand, at least one pair of upper and lower working rolls provided in said rolling stand which working rolls are movable in a direction toward a driving side of said rolling mill and in another direction reverse to the former direction each of which working rolls is moved in a direction reverse to each other, grinding means provided in the rolling stand which grinding means grinds a surface of said working rolls, means for storing and calculating a cumulative number of pieces of rolled plate produced or an amount of rolling performed in a period of time continuing from initial use of said working rolls, and grinding-instructing means for instructing the grinding means to perform grinding of the working rolls when said number of pieces of said rolled plate or the amount of said rolling reaches a given value, said method comprising the steps of storing and calculating a cumulative number of pieces of rolled plate produced or an amount of rolling performed in a period of time continuing from initial use of said working rolls, and instructing the grinding means to perform grinding of the working rolls when said number of pieces of said rolled plate or the amount of said rolling reaches a given value.

* * * * *